US010189046B2

(12) United States Patent
Vijay et al.

(10) Patent No.: US 10,189,046 B2
(45) Date of Patent: Jan. 29, 2019

(54) METHOD AND APPARATUS FOR PREPPING BORES AND CURVED INNER SURFACES WITH A ROTATING HIGH-FREQUENCY FORCED PULSED WATERJET

(71) Applicant: VLN Advanced Technologies Inc., Ottawa, Ontario (CA)

(72) Inventors: Mohan M. Vijay, Gloucester (CA); Andrew Hung Tieu, Ottawa (CA); Wenzhuo Yan, Ottawa (CA); Bruce R. Daniels, Ottawa (CA)

(73) Assignee: VLN Advanced Technologies Inc., Ottawa (CA)

( * ) Notice: Subject to any disclaimer, the term of this patent is extended or adjusted under 35 U.S.C. 154(b) by 112 days.

(21) Appl. No.: 14/285,196

(22) Filed: May 22, 2014

(65) Prior Publication Data

US 2014/0252107 A1 Sep. 11, 2014

Related U.S. Application Data

(60) Division of application No. 14/019,160, filed on Sep. 5, 2013, now Pat. No. 9,757,756, and a continuation (Continued)

(51) Int. Cl.
*B24C 3/32* (2006.01)
*B08B 9/049* (2006.01)

(Continued)

(52) U.S. Cl.
CPC ..... *B05B 17/0653* (2013.01); *B05B 1/08* (2013.01); *B05B 1/083* (2013.01); *B05B 3/06* (2013.01);

(Continued)

(58) Field of Classification Search
CPC .... B24C 3/16; B24C 3/28; B24C 3/32; B24C 3/325; B24C 5/04; B08B 9/049;

(Continued)

(56) References Cited

U.S. PATENT DOCUMENTS 2,125,915 A * 8/1938 Halbing ..... 239/548
2,569,251 A * 9/1951 Nieburg ..... 239/8

(Continued)

FOREIGN PATENT DOCUMENTS

CN 101676036 A 3/2010
CN 101811121 A 8/2010

(Continued)

OTHER PUBLICATIONS

Mohan et al. "Ultrasonically Modulated Pulsed Jets: Basic Study", BHR Group Conferences Series—12th International Conference on Jetting Technology, No. 13, Oct. 27, 1994, pp. 15-35.

(Continued)

*Primary Examiner* — Eileen Morgan
(74) *Attorney, Agent, or Firm* — O'Shea Getz P.C.

(57) ABSTRACT

A method of prepping a cylindrical inner surface of a bore using a high-frequency forced pulsed waterjet apparatus entails generating a pressurized waterjet using a high-pressure water pump, generating a high-frequency signal using a high-frequency signal generator, applying the high-frequency signal to a transducer having a microtip to cause the microtip to vibrate to thereby generate the high-frequency forced pulsed waterjet, and rotating the rotatable ultrasonic nozzle inside the bore to prep the inner cylindrical surface of the bore using the high-frequency forced pulsed waterjets exiting from the angled exit orifices of the rotatable ultrasonic nozzle.

8 Claims, 37 Drawing Sheets

Related U.S. Application Data of application No. 12/504,188, filed on Jul. 16, 2009, now Pat. No. 8,550,873.

(51) Int. Cl.

| | |
|---|---|
| ***B05B 1/14*** | (2006.01) |
| ***B05B 17/06*** | (2006.01) |
| ***B05B 17/00*** | (2006.01) |
| ***B05B 1/08*** | (2006.01) |
| ***B05B 3/06*** | (2006.01) |
| ***B05B 13/06*** | (2006.01) |
| ***B05B 3/02*** | (2006.01) |
| ***B24C 5/04*** | (2006.01) |

(52) U.S. Cl.

CPC ..... *B05B 13/0636* (2013.01); *B05B 17/063* (2013.01); *B05B 17/0607* (2013.01); *B05B 17/0638* (2013.01); *B08B 9/0495* (2013.01); *B24C 3/32* (2013.01); *B24C 3/325* (2013.01); *B24C 5/04* (2013.01); *B05B 1/14* (2013.01); *B05B 3/02* (2013.01); *B05B 17/0623* (2013.01)

(58) Field of Classification Search

CPC ..... B08B 9/0495; B05B 1/083; B05B 1/14; B05B 3/02; B05B 3/06; B05B 13/0636; B05B 17/06; B05B 17/0607; B05B 17/0623; B05B 17/063; B05B 17/0638; B05B 17/0646

USPC ..... 451/76, 102

See application file for complete search history.

(56) References Cited

U.S. PATENT DOCUMENTS

| | | | | | |
|---|---|---|---|---|---|
| 3,373,752 | A | | 3/1968 | Inoue | |
| 3,760,848 | A | * | 9/1973 | Rehsteiner | 137/828 |
| 3,987,963 | A | | 10/1976 | Pacht | |
| 4,119,160 | A | * | 10/1978 | Summers et al. | 175/67 |
| 4,478,368 | A | * | 10/1984 | Yie | 239/430 |
| 4,555,872 | A | * | 12/1985 | Yie | 451/40 |
| 4,681,264 | A | | 7/1987 | Johnson et al. | |
| 4,715,539 | A | | 12/1987 | Steele | |
| 4,787,178 | A | | 11/1988 | Morgan et al. | |
| 4,821,961 | A | | 4/1989 | Shook | |
| 4,966,059 | A | | 10/1990 | Landeck | |
| 4,995,201 | A | * | 2/1991 | von Borcke et al. | 451/76 |
| 5,134,347 | A | | 7/1992 | Koleda | |
| 5,154,347 | A | | 10/1992 | Vijay | |
| 5,380,068 | A | * | 1/1995 | Raghavan | 299/17 |
| 5,390,450 | A | * | 2/1995 | Goenka | 451/75 |
| 5,405,283 | A | * | 4/1995 | Goenka | 451/39 |
| 5,512,318 | A | | 4/1996 | Raghavan et al. | |
| 5,570,712 | A | | 11/1996 | Mathieus | |
| 5,584,016 | A | | 12/1996 | Varghese et al. | |
| 5,622,753 | A | | 4/1997 | Shepley et al. | |
| 5,778,713 | A | * | 7/1998 | Butler et al. | 72/53 |
| 5,794,858 | A | | 8/1998 | Munoz | |
| 6,021,699 | A | | 2/2000 | Caspar | |
| 6,126,524 | A | | 10/2000 | Shepherd | |
| 6,220,529 | B1 | | 4/2001 | Xu | |
| 6,533,640 | B1 | | 3/2003 | Nopwaskey et al. | |
| 6,824,453 | B1 | * | 11/2004 | Andersson | 451/102 |
| 7,594,614 | B2 | * | 9/2009 | Vijay et al. | 239/101 |
| 8,006,915 | B2 | * | 8/2011 | Vijay et al. | 239/4 |
| 8,286,468 | B2 | | 10/2012 | Nishimura et al. | |
| 8,360,337 | B2 | * | 1/2013 | Vijay et al. | 239/4 |
| 8,387,894 | B2 | * | 3/2013 | Vijay et al. | 239/4 |
| 8,550,873 | B2 | * | 10/2013 | Vijay et al. | 451/3 |
| 8,959,749 | B2 | | 2/2015 | Flores et al. | |
| 9,109,276 | B2 | | 8/2015 | Kanai et al. | |
| 2002/0109017 | A1 | | 8/2002 | Rogers et al. | |
| 2002/0124868 | A1 | | 9/2002 | Rice et al. | |
| 2002/0173220 | A1 | * | 11/2002 | Lewin et al. | 451/2 |
| 2003/0056811 | A1 | | 3/2003 | Walker et al. | |
| 2004/0089450 | A1 | | 5/2004 | Slade et al. | |
| 2007/0063066 | A1 | | 3/2007 | Vijay et al. | |
| 2010/0237165 | A1 | * | 9/2010 | Krueger | 239/11 |
| 2012/0322347 | A1 | | 12/2012 | Molz et al. | |
| 2015/0107076 | A1 | | 4/2015 | Maki et al. | |

FOREIGN PATENT DOCUMENTS

| | | | | |
|---|---|---|---|---|
| CN | 102041795 | A | 5/2011 | |
| EP | 0983827 | | 3/2000 | |
| GB | 1568680 | A | 6/1980 | |
| JP | S4214545 | | 8/1967 | |
| WO | WO 2005042177 | A1 * | 5/2005 | B08B 3/02 |

OTHER PUBLICATIONS

Vijay, Mohan "Design and Development of a Prototype Pulsed Waterjet Machine for the Removal of Hard Coatings", BHR Group Conferences Series—14th International Conference on Jetting Technology, No. 32, Sep. 23, 1998, pp. 39-57.

Foldyna et al. "Utilization of Ultrasound to Enhance High-Speed Water Jet Effects", Ultrasonics: Sonochemistry, vol. 11, No. 3-4, May 1, 2004, pp. 131-137.

Canadian Office action dated Oct. 13, 2011.

EP Office action, dated Mar. 14, 2011.

Vijay et al. "Removal of Hard Coatings from the Interior of Ships Using PUlsed Waterjets: Results of Field Trials", Proceedings of the 10th American Waterjet Conference, Paper 53, Aug. 17, 1999, pp. 670-687, https://www.wjta.org/images/wjta/Proceedings/Proceed%201999.pdf.

Puchala et al. "Study of an Ultrasonically Generated Cavitating or Interrupted Jet: Aspects of Design", International Symposium on Jet Cutting Technology Proceedings, vol. 7, Jan. 1, 1984, pp. 69-82.

EP search report for EP12181935.3 dated Jun. 19, 2017.

EP search report for EP12181942.9 dated Jun. 21, 2017.

EP search report for EP18161562.6 dated Jul. 6, 2018.

* cited by examiner

METHOD AND APPARATUS FOR PREPPING BORES AND CURVED INNER SURFACES WITH A ROTATING HIGH-FREQUENCY FORCED PULSED WATERJET

CROSS-REFERENCE TO RELATED APPLICATIONS

This application is a divisional of U.S. patent application Ser. No. 14/019,160 which is a continuation of U.S. patent application Ser. No. 12/504,188 which claims priority under 35 U.S.C. 119(e) from U.S. Provisional Patent Application 61/081,177 filed Jul. 16, 2008 entitled METHOD AND APPARATUS FOR PREPPING SURFACES WITH A HIGH-FREQUENCY FORCED PULSED WATERJET.

TECHNICAL FIELD

The present invention relates generally to forced pulsed waterjets and, in particular, to surface prepping using forced pulsed waterjets.

BACKGROUND

Continuous plain waterjets (CWJ) have been used in the prior art to prep metallic and non-metallic surfaces. Continuous plain waterjets are waterjets that are not modulated or pulsed. To prep surfaces using these conventional continuous plain waterjets, these waterjets must typically be operated at very high pressures such as, for example, pressures of approximately 60,000 psi. Operating continuous plain waterjets at such high pressures not only requires expensive high-pressure pumps, lines, fittings, etc., but also utilizes copious amounts of energy. These very high pressure waterjets are thus expensive and prone to breakdown.

Examples of continuous-flow, high-pressure waterjet systems for cutting and cleaning are disclosed in U.S. Pat. No. 4,787,178 (Morgan et al.), U.S. Pat. No. 4,966,059 (Landeck), U.S. Pat. No. 6,533,640 (Nopwaskey et al.), U.S. Pat. No. 5,584,016 (Varghese et al.), U.S. Pat. No. 5,778,713 (Butler et al.), U.S. Pat. No. 6,021,699 (Caspar), U.S. Pat. No. 6,126,524 (Shepherd) and U.S. Pat. No. 6,220,529 (Xu). Further examples are found in European Patent Applications EP 0 810 038 (Munoz) and EP 0 983 827 (Zumstein), as well as in US Patent Application Publications 2002/0109017 (Rogers et al.), 2002/0124868 (Rice et al.), and 2002/0173220 (Lewin et al.).

As noted above, continuous-flow waterjet technology, of which the foregoing are examples, suffers from certain drawbacks which render continuous-flow waterjet systems expensive and cumbersome. As persons skilled in the art have come to appreciate, continuous-flow waterjet equipment must be robustly designed to withstand the extremely high water pressures involved. Consequently, the nozzle, water lines and fittings are bulky, heavy and expensive. To deliver an ultra-high-pressure waterjet, an expensive ultra-high-pressure water pump is required, which further increases costs both in terms of the capital cost of such a pump and the energy costs associated with running such a pump.

In response to the shortcomings of continuous-flow waterjets, an ultrasonically pulsating nozzle was developed to deliver high-frequency modulated water in non-continuous, discrete packets, or "slugs". This ultrasonic nozzle is described and illustrated in detail in U.S. Pat. No. 5,134,347 (Vijay) which issued on Oct. 13, 1992. The ultrasonic nozzle disclosed in U.S. Pat. No. 5,134,347 transduced ultrasonic oscillations from an ultrasonic generator into ultra-high frequency mechanical vibrations capable of imparting thousands of pulses per second to the waterjet as it travels through the nozzle. The waterjet pulses impart a waterhammer pressure onto the surface to be cut or cleaned. Because of this rapid bombardment of mini-slugs of water, each imparting a waterhammer pressure on the target surface, the erosive capacity of the waterjet is tremendously enhanced. The ultrasonically pulsating nozzle is thus able to cut or clean much more efficiently than the prior-art continuous-flow waterjets.

Theoretically, the erosive pressure of a continuous waterjet striking the target surface is the stagnation pressure, or $\frac{1}{2}\rho v^2$ (where $\rho$ represents the water density and v represents the impact velocity of the water as it impinges on the target surface). The pressure arising due to the waterhammer phenomenon, by contrast, is $\rho cv$ (where c represents the speed of sound in water, which is approximately 1524 m/s).

Thus, the theoretical magnification of impact pressure achieved by pulsating waterjet is 2 c/v. As an example, if the impact velocity is 1,200 ft/s (372 m/s), generated by a pump operating at 10 kpsi (69 MPa), the magnification would be eight. Even if air drag neglected and the impact velocity is assumed to approximate the fluid discharge velocity of 1500 feet per second (or approximately 465 m/s), the magnification of impact pressure is about 6 to 7. If the model takes into account air drag, and assuming an impact velocity of about 300 m/s, then the theoretical magnification would be tenfold.

In practice, due to aerodynamic drag on the pulses and due to frictional and other inefficiencies, the pulsating ultrasonic nozzle described in U.S. Pat. No. 5,154,347 imparts about 3 to 5 times more impact pressure onto the target surface for a given source pressure. Therefore, to achieve the same erosive capacity, the pulsating nozzle need only operate with a pressure source that is 3 to 5 times less powerful. Since the pulsating nozzle may be used with a much smaller and less expensive pump, it is more economical than continuous-flow waterjet nozzles. Further, since waterjet pressure in the nozzle, lines, and fittings is much less with an ultrasonic nozzle, the ultrasonic nozzle can be designed to be lighter, less cumbersome and more cost-effective.

Although the basic ultrasonic nozzle described in U.S. Pat. No. 5,154,347 and the improvements presented in WO/2005/042177) entitled ULTRASONIC WATERJET APPARATUS (which are both hereby incorporated by reference) represent substantial breakthroughs in waterjet technology, in these early technologies only cursory/scant attention was paid to surface prepping. Accordingly, a method and apparatus for prepping surfaces that improves on the prior art technology would be highly desirable. These innovations and improvements are disclosed by Applicants in the present application.

SUMMARY OF THE INVENTION

The present invention provides a rotating forced pulsed waterjet (FPWJ) technology that is designed for surface prepping of bores or inner cylindrical surfaces that may be either metallic or non-metallic surfaces. Forced pulsed waterjets represent a substantial improvement over continuous plain (ultra-high pressure) waterjet technologies in terms of surface prepping performance. Forced pulsed waterjets can be specifically tailored to produce exact and highly uniform surface finish characteristics by adjusting key operating parameters such as the frequency (f) and amplitude (A) of the signal that drives the transducer, the water flow rate (Q) and pressure (P), and certain key dimensions of the nozzle, such as the diameter d of the exit orifice, the ratio L/d where L represents the length of the cylindrical portion of the exit orifice, and the parameter 'a' where 'a' represents the distance from the microtip to the orifice exit. Surface characteristics (finish and patterning) can also be controllably varied by adjusting operating parameters such as the standoff distance (SD) and the traverse velocity ($V_{TR}$).

This novel surface prepping technology has many industrial applications. This surface prepping technology can be used to prep the surfaces of metals, plastics, woods, ceramics, composites, rocks and concrete, or other material. This technology can be used to produce a highly predictable surface finish on any given material by selecting the operating parameters accordingly.

In accordance with one main aspect of the present invention, a novel method of prepping a cylindrical inner surface of a bore using a high-frequency forced pulsed waterjet apparatus entails generating a pressurized waterjet using a high-pressure water pump, generating a high-frequency signal using a high-frequency signal generator, applying the high-frequency signal to a transducer having a microtip to cause the microtip to vibrate to thereby generate the high-frequency forced pulsed waterjet, and rotating the rotatable ultrasonic nozzle inside the bore to prep the inner cylindrical surface of the bore using the high-frequency forced pulsed waterjets exiting from the angled exit orifices of the rotatable ultrasonic nozzle.

In accordance with another main aspect of the present invention, a novel forced pulsed waterjet apparatus has a high-pressure water pump for generating a pressurized waterjet, a high-frequency signal generator for generating a high-frequency signal, and a rotatable ultrasonic nozzle comprising a transducer having a microtip for converting the high-frequency signal into vibrations that pulse the pressurized waterjet and two angled exit orifices for prepping an inner cylindrical surface of a bore into which the nozzle is inserted.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

In general, the present invention pertains to both a novel method of surface prepping and pattern creation using a forced pulsed waterjet (FPWJ), also referred to herein as an ultrasonically modulated waterjet, and a novel ultrasonic waterjet apparatus for surface prepping materials to within prescribed surface roughness parameters, i.e. to a prescribed surface finish. These techniques can be used to prep the surface of any kind of material, either metallic or non-metallic. For example, this technique can be used to prep the surface of steel, stainless steel, aluminum, iron, titanium, brass, copper, any alloys thereof, or any other type of metal. This technique can also be used to prep the surface of woods, plastics and polymers, composites, ceramics, or any other type of non-metallic material.

Underlying Theory of Forced Pulsed Waterjets

To appreciate fully this novel technology, a brief review of the underlying theory of forced pulsed waterjets (FPWJ) is in order to understand why the waterjet impact on a material target is magnified by ultrasonic modulation. Consider first (as a baseline reference) when a steady continuous waterjet (CWJ) impinges normally on any surface to be cut or cleaned, the maximum pressure at the point of impact is called the stagnation pressure $P_s$, given by:

$$Ps=\tfrac{1}{2}\rho v^2$$

Where v=speed of the jet and p=density of water. V is proportional to √P, the static pressure at the nozzle inlet (pump pressure)−(frictional losses). However, if a drop or a slug of water strikes the same surface, the initial impact pressure will be much higher. This is the waterhammer pressure given by:

$$P=\rho vc$$

Where c=speed of sound in water=1524 m/s (5,000 ft/s). The time during which the waterhammer pressure acts is:

$$t=d/2c$$

(d=nozzle diameter)

From the above equations, it is clear that the amplification of pressure on the surface is:

$$M=P/Ps=2C/v$$

For example:

TABLE 1

| ps (psi) | 5,000 | 7,500 | 10,000 | 12,500 | 15,000 | 17,500 | 20,000 |
|---|---|---|---|---|---|---|---|
| BAR | 350 bar | 500 bar | 700 bar | 860 bar | 1,030 bar | 1,200 bar | 1,380 bar |

TABLE 1-continued

| ps (psi) | 5,000 | 7,500 | 10,000 | 12,500 | 15,000 | 17,500 | 20,000 |
|---|---|---|---|---|---|---|---|
| (MPa) | 34.5 | 52.2 | 69.0 | 86.2 | 103.5 | 121.0 | 138.0 |
| M | 11.6 | 9.5 | 8.2 | 7.3 | 6.7 | 6.2 | 5.8 |

That is, for example, when the pump is set to operate at 69 MPa, the waterhammer pressure on the target would be 566 MPa (82,000 psi!). Since the behavior of the material depends on the impact pressure and time (determined by the frequency and the nozzle diameter), significant improvement in material erosion (i.e. prepping performance) is achieved with the use of forced pulsed waterjets.

Figure 1A:
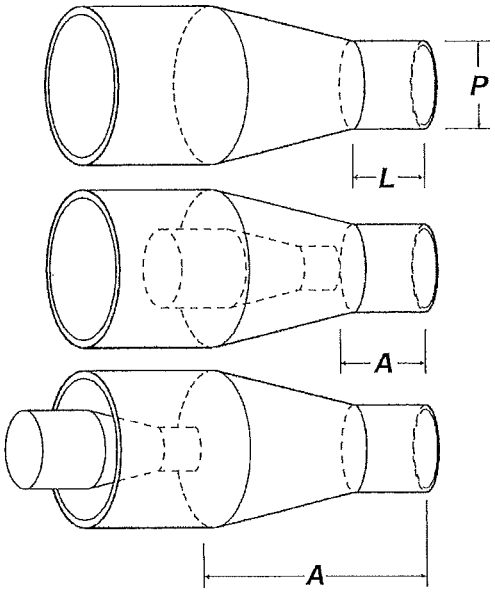
FIG. 1A are depictions of a regular waterblasting nozzle and a nozzle with a microtip of diameter D set back a distance 'a' from the exit plane of the exit orifice.
Figure 1B:
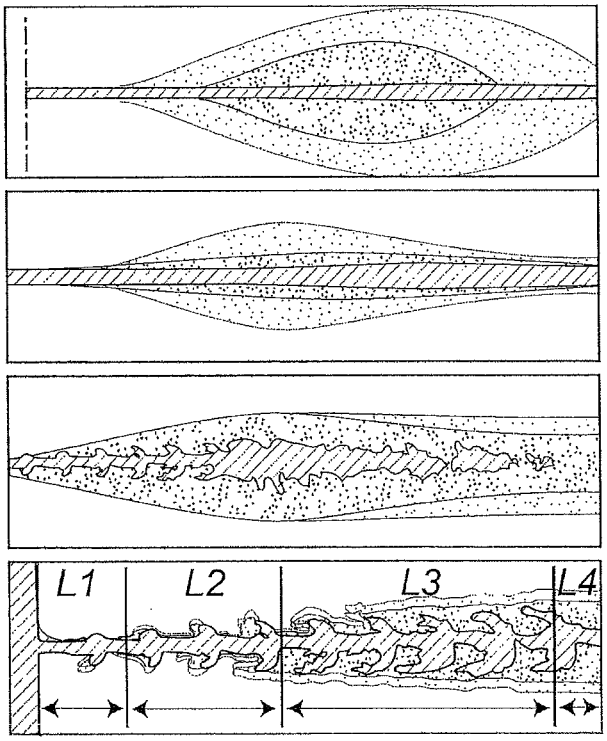
FIG. 1B are representations of a regular continuous jet, a waterjet at the onset of modulation, a waterjet in transition, and a fully developed forced pulsed waterjet having four distinct regions labelled as L1, L2, L3 and L4.

FIG. 1A shows how a forced pulsed waterjet (FPWJ) is formed by modulating the water flow through a regular waterblast nozzle such as the one shown at the top of FIG. 1A. For a given water pressure (P) and flow rate (Q) and for a given position of the tip (which is designated by parameter 'a', and which is shown in FIG. 1A), the continuous stream starts modulating with the gradually applied ultrasonic power to the probe (microtip), through an ultrasonic transducer, as will be elaborated below. FIG. 1B shows a steady continuous waterjet ("regular waterjet"), a waterjet at the onset of modulation, a waterjet during the transition phase, and a fully developed forced pulsed waterjet. As depicted in FIG. 1B, the fully developed forced pulsed waterjet is characterized by a first zone of length L1 in which the waterjet is incompletely modulated and thus behaves almost like a continuous waterjet (CWJ). In a second zone of length L2, pulses begin to appear, but are not fully developed. In a third zone of length L3, pulses are large and well-defined, i.e. discrete slugs of water with large diameters compared to the regular waterjet (CWJ). In fact, this is one of the reasons for the tremendous efficacy of the FPWJ, apart from the waterhammer pressure and frequency. In other words, the FPWJ removes (or preps) a much wider path per pass compared to the CWJ at the same operating conditions. In a fourth zone of length L4, the FPWJ degenerates into droplets due to aerodynamic drag (normally, the droplet-laden jet is called a "fanjet", which is used for removing soft coatings, etc.) In this case, it can be referred to more specifically as a forced high-frequency fanjet.

Thus, as will be elaborated below, the ultrasonic nozzle used to produce the FPWJ is configured to produce fully developed pulses of water (such as those of zone L3) at the desired standoff distance. This will produce a highly precise and uniform surface finish on a given material. The overall performance of this novel FPWJ technology has been demonstrated to be far superior to conventional CWJ technologies. Accordingly, this novel FPWJ technology represents a revolutionary advance in the realm of waterjet surface prepping technologies.

As the fluid characteristics of the forced pulsed waterjet (FPWJ) are a complex function of nozzle configuration (e.g. L/d ratio), pressure, waterflow, frequency, amplitude, and the 'a' distance (tip-to-orifice distance), an efficient technique for correlating the various operating parameters to the performance of the forced pulsed waterjet (and hence on the surface finish produced) involves performing a "drop-test", which is described in greater detail below with reference to FIGS. 6-24. First, however, the novel apparatus and novel method will be described in detail with reference to FIGS. 1C to 5.

The preferred embodiments of both major aspects of the present invention (apparatus and method) will now be described below, by way of example, with reference to the attached drawings.

Apparatus

Figure 1C:
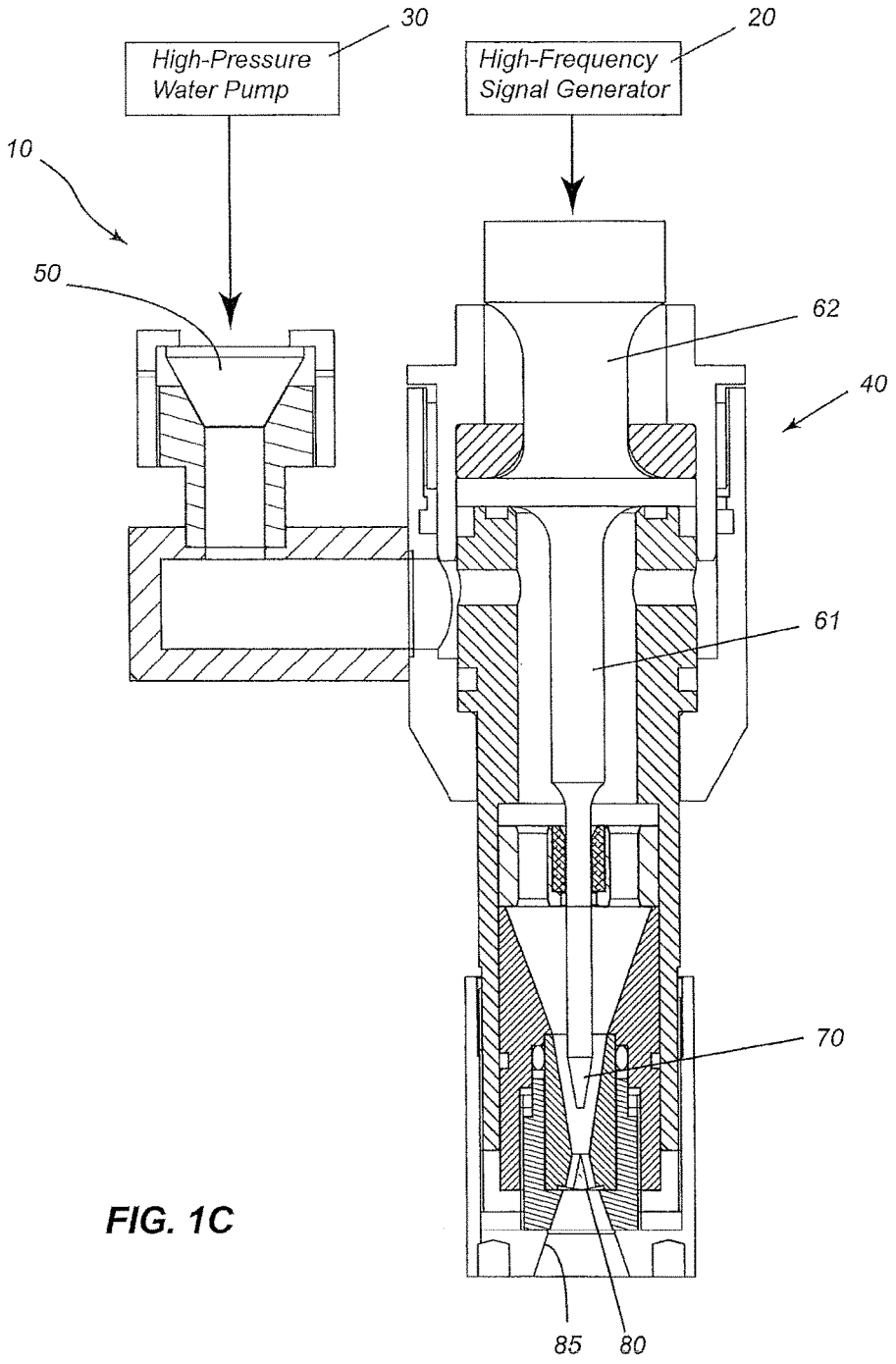
FIG. 1C depicts a forced pulsed waterjet apparatus for use in surface prepping (or other applications such as coating removal or creating patterns) in accordance with embodiments of the present invention.
Figure 1D:
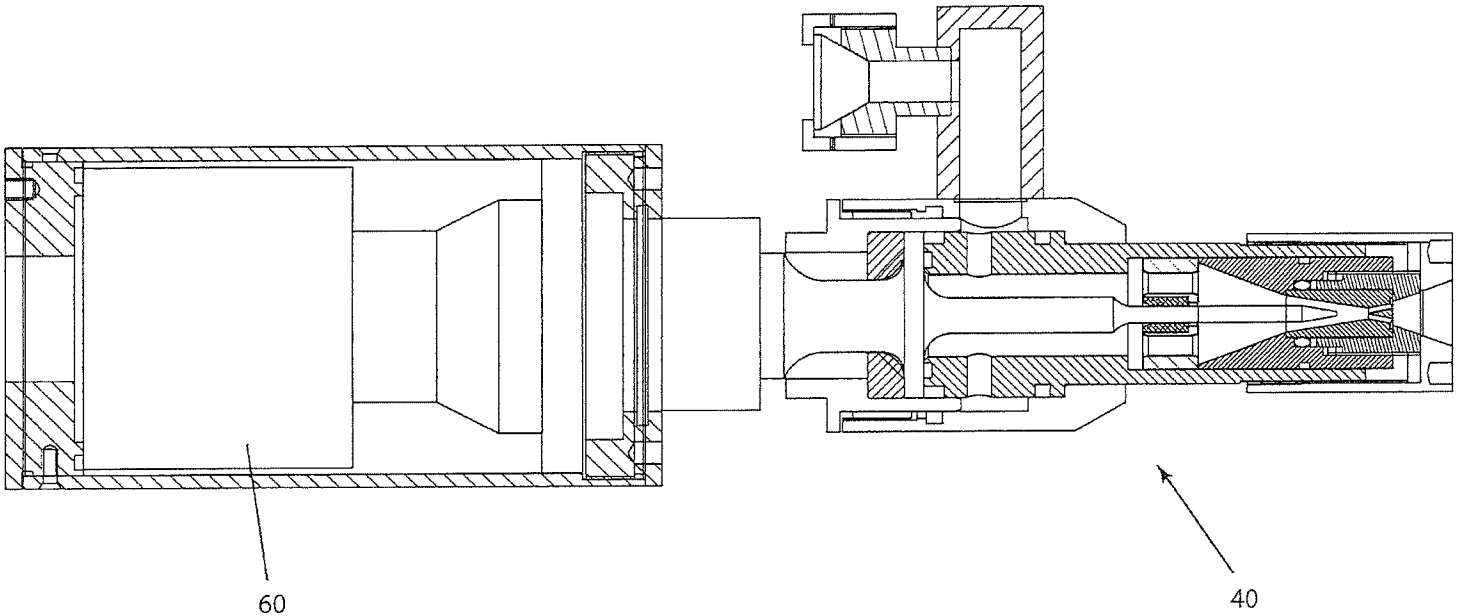
FIG. 1D depicts a force pulsed waterjet nozzle having a piezoelectric transducer that can be used for implementing the surface prepping and pattern-creation techniques disclosed herein.

FIG. 1C illustrates a forced pulsed waterjet (FPWJ) apparatus, which is designated generally by reference numeral 10, in accordance with one embodiment of the present invention. This FPWJ apparatus is also referred to herein as an ultrasonic waterjet apparatus. This novel forced pulsed waterjet apparatus is specially designed for prepping a surface that is either metallic or non-metallic. This apparatus can also be used for creating patterns on the surface. For the purposes of this specification, the expression "surface prepping" is meant to encompass the creating of surface patterns. Similarly, references herein to techniques for producing the desired surface roughness are meant to include techniques for producing desired surface patterns.

Figure 2:
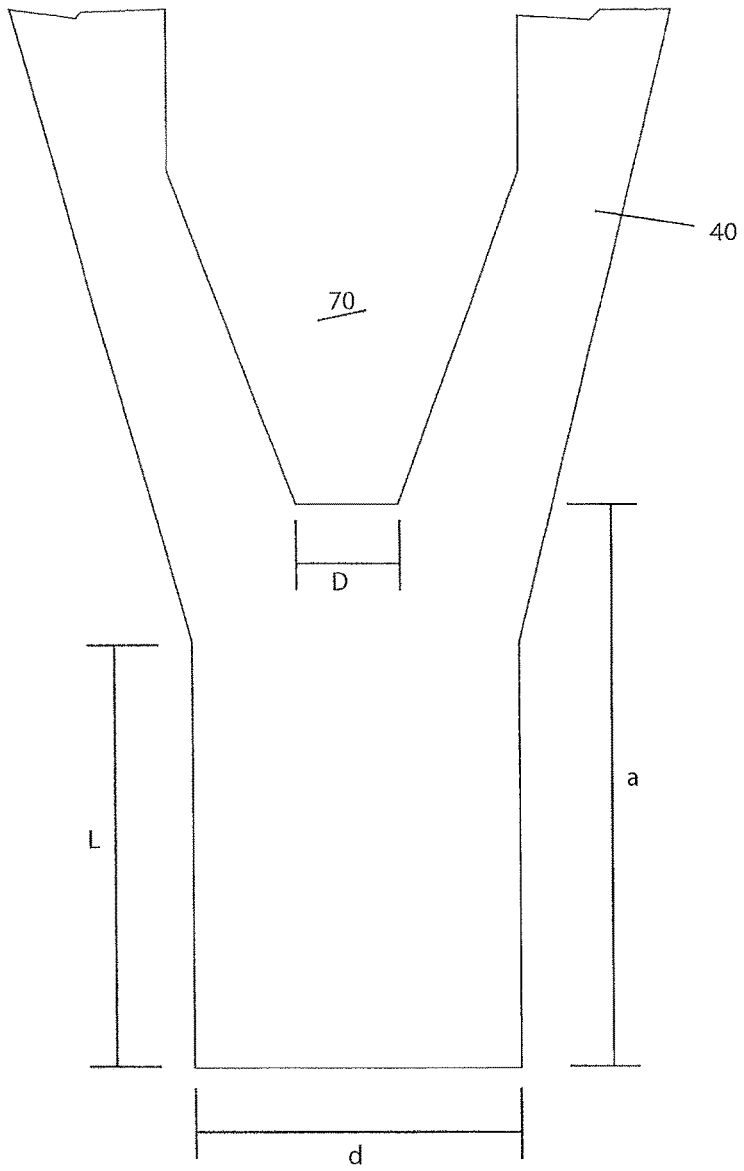
FIG. 2 depicts the geometry of a microtip and exit orifice in a nozzle of a forced pulsed waterjet apparatus.

As depicted in FIG. 1C, this novel forced pulsed waterjet (FPWJ) apparatus 10 comprises a high-pressure water pump 30 for generating a pressurized waterjet having a water pressure P and a water flow rate Q which are connected to water inlet 50. This FPWJ apparatus 10 also comprises a high-frequency signal generator 20 (which could be the retrofit module (RFM) disclosed in WO/2005/042177). This signal generator can be used for generating a high-frequency signal of frequency f and amplitude A. The frequency and amplitude can be adjusted on the signal generator. The FPWJ apparatus 10 further comprises an ultrasonic nozzle 40 having a transducer 60 (shown in FIG. 1D) for converting the high-frequency electrical signal into oscillations of the microtip (or acoustic waves downstream of the microtip) that pulse the pressurized waterjet. The transducer 60 can be piezoelectric transducer or a magnetostrictive transducer. The nozzle 40 has a microtip 70 of diameter D for ultrasonically modulating the pressurized waterjet. The microtip 70 is preferably connected via a stem 61 and a stub 62 (shown in FIG. 1C) to the transducer. The microtip 70 is spaced a distance 'a' from an exit orifice 80 of the nozzle, i.e. from the exit plane of the exit orifice 80, as shown in FIG. 2. This distance 'a' is very important in controlling the performance characteristics of the waterjet. The geometry of the nozzle is also very important. In particular, the ratio L/d is a very important parameter where L is the length of the cylindrical portion of the exit orifice and d is the diameter of exit orifice, as also shown in FIG. 2. Another important ratio is D/d where D is the diameter of the tip and d is the diameter of the exit orifice, as depicted in FIG. 2. Other operating parameters that have effect on the behaviour and performance of the waterjet are the frequency f and amplitude A of the high-frequency signal, the water pressure P and flow rate Q, and a traverse velocity $V_{TR}$ of the nozzle. By taking into account all of these controlling parameters, a suitable forced pulsed waterjet can be generated whose pulses are specifically designed to prep a surface of a given material that is spaced at a standoff distance SD from the nozzle so as to produce a substantially uniform and predictable surface roughness on the surface of the material. The pulses of water generated by the FPWJ have a broad, substantially flattened frontal profile (leading edge). This is highly advantageous since each successive pulse acts (i.e. preps, cuts, patterns, etc.) over a broader swath than would be possible with a comparable CWJ. Furthermore, the profile of each pulse is substantially flat at the leading edge of each pulse which means that an even prepping is achieved. This is to be contrasted with the CWJ profile which is generally parabolic, meaning that its erosive power is maximal along the centerline of the jet but drops off parabolically as a function of distance from the centerline. This means that a CWJ will typically provide uneven surface prepping or material removal. In contrast, the FPWJ apparatus provides an even and broad swath of pulses. The substantially flattened leading-edge profile (i.e. the broad even swath) of the pulses generated by the FPWJ apparatus is far more efficient than the parabolic profile of the CWJ.

The waterjet apparatus preferably has an L/d ratio that is between 2:1 and 0.5:1. This range of L/d ratios are believed to provide optimal performance. In particular, a L/d ratio of 1:1 is believed to be most optimal. Based on extensive empirical data, the L/d ratio is believed to be very important in governing the performance of the FPWJ, and in particular, in its ability to predictably and uniformly prep a surface.

The effective standoff distance, as shown in zone L3 of FIG. 1B, can be any distance depending on the pressure P and flow Q. However, for most industrial applications, the range of standoff distances is between 0.5" and 5.0". These standoff distances are believed to provide optimal performance, by allowing the pulses to form as discrete slugs downstream of the orifice (as shown in zone L3 of FIG. 1B) before they become deformed by the effects of air resistance.

The waterjet apparatus preferably has an exit orifice diameter d between 0.010" and 0.500". Excellent results have also been attained with d between 0.040" and 0.065". The diameter d depends on P and Q.

The waterjet apparatus preferably operates at a water pressure P of between 1000 psi and 20,000 psi.

The ratio D/d (where D represents the diameter of the microtip and d represents the diameter of the exit orifice) is preferably between 1 and 1.5.

For optimal performance, the exit orifice 80 has a converging shape, preferably either a bell-mouthed shape or a conically converging shape 85 as shown in FIG. 1C to maximally preserve pulses when exiting the nozzle.

This novel ultrasonic waterjet apparatus can be used to prep surfaces that are either metallic (e.g. aluminum, steel, stainless steel, iron, copper, brass, titanium, alloys, etc.) or non-metallic (e.g. wood, plastic, ceramic or composites). Virtually any kind of surface roughness or surface finish can be produced by designing a suitable nozzle and by controlling the operating parameters accordingly. This novel technology can be used on surfaces that are flat (e.g. panels, plates, etc.) or curved (pipes, tubes, etc.) or even odd-shaped parts or for prepping internal and outer areas of curved surfaces.

Rotating Nozzles

FIGS. 3A to 3D show in schematic form various example rotating ultrasonic nozzles that can be used for prepping the insides of cylindrical or tubular structures such as, for example, pipes, tubes, etc.

Figure 3A:
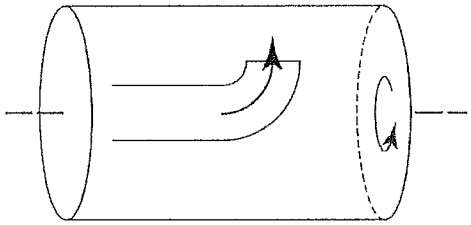
FIG. 3A schematically depicts a 90-degree elbow ultrasonic nozzle.
Figure 3B:
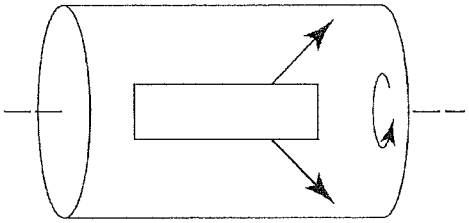
FIG. 3B schematically depicts a nozzle with dual angled orifices.
Figure 3C:
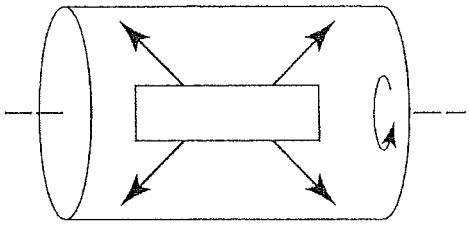
FIG. 3C schematically depicts a nozzle with two forwardly angled orifices and two rearwardly angled orifices.
Figure 3D:
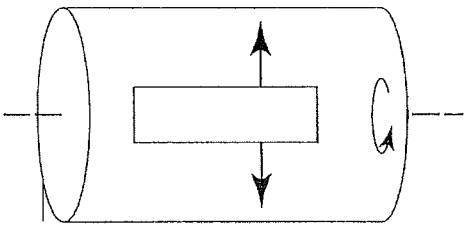
FIG. 3D schematically depicts a nozzle with two 90-degree orifices.

FIG. 3A schematically depicts an ultrasonic nozzle with a 90-degree elbow. FIG. 3B schematically depicts a dual-orifice ultrasonic nozzle (e.g. a nozzle with two forwardly angled orifices). FIG. 3C schematically depicts a four-orifice ultrasonic nozzle with two forwardly angled orifices and two rearwardly angled orifices. For example, the forwardly angled exit orifices could be angled at substantially 45-degrees to an axis of displacement of the microtip whereas the rearwardly angled exit orifices could be angled at substantially 135 degrees from the axis of displacement of the microtip. Of course, other angles could be used. FIG. 3D schematically depicts an ultrasonic nozzle with two 90-degree (orthogonally disposed) orifices.

It should, of course, be understood that these four examples (FIG. 3A to 3D) are presented merely to illustrate four different ways of designing such a nozzle. Accordingly, other nozzle designs can be devised that utilize the same principles.

In each of these examples, the orifice(s) can be conical, cylindrical, or bell-shaped ("bell mouth").

Figure 3E:
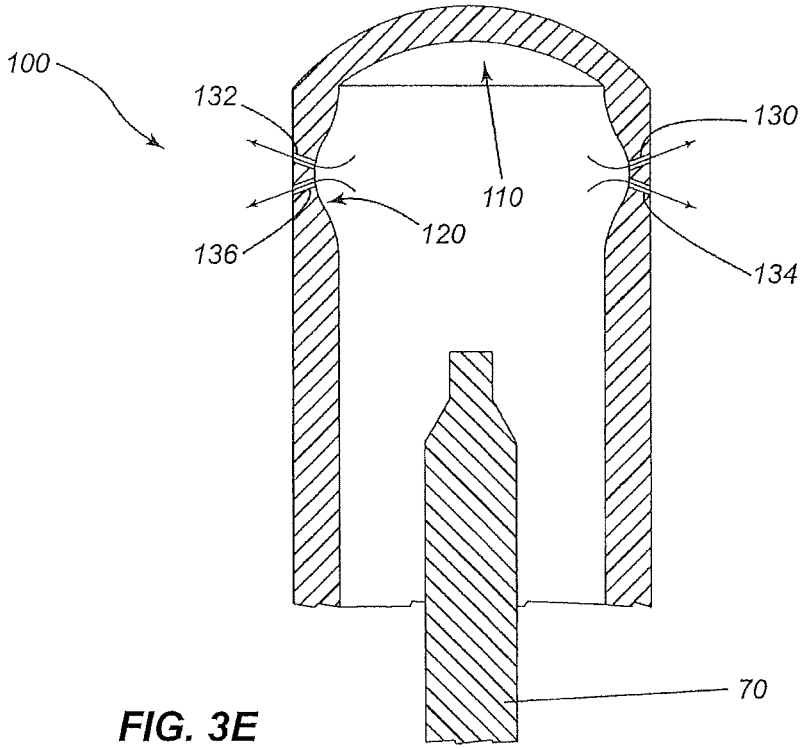
FIG. 3E is a cross-sectional view of a four-orifice ultrasonic nozzle.
Figure 3F:
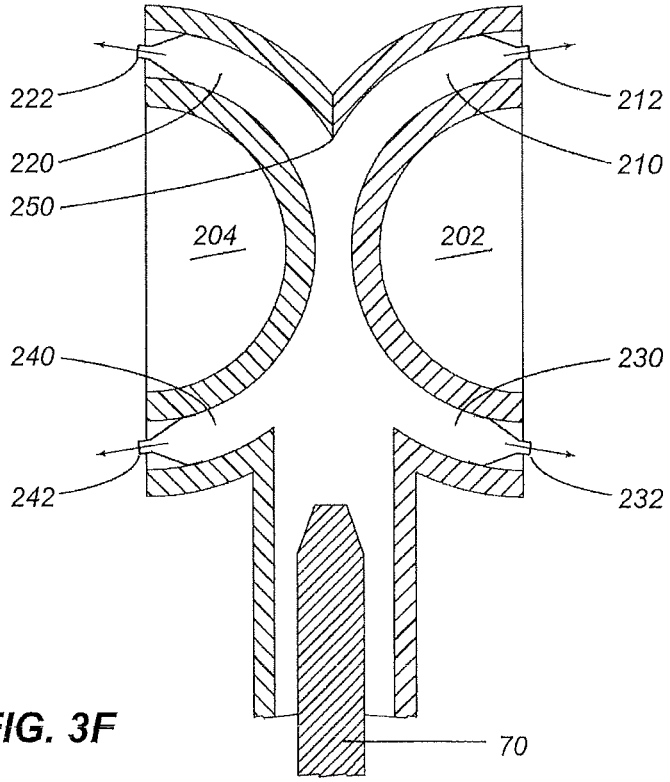
FIG. 3F is a cross-sectional view of a four-orifice ultrasonic nozzle.

Some more detailed nozzle designs for the rotating four-orifice nozzle introduced in FIG. 3C are presented by way of example in FIG. 3E and FIG. 3F.

FIG. 3E is a cross-sectional view of a four-orifice rotating ultrasonic nozzle (designated now by reference numeral 100) comprising two forwardly angled exit orifices 130, 132 and two rearwardly angled exit orifices 134, 136. As shown in FIG. 3E, the exit orifices have respective diameters d1, d2, d3 and d4. In one embodiment, these diameters can all be the same, i.e. d1=d2=d3=d4. In another embodiment, these diameters can all be different. In yet another embodiment, the two forwardly angled orifices are the same (d1=d4) while the two rearwardly angled orifices are the same (d2=d3). Similarly, these exit orifices can be angled at a common angle theta (θ and −θ) with respect to the normal, or these orifices can have different angles for each of θ1, θ2, θ3, θ4. Still alternatively, the angles of the forward orifices 130, 132 can be made to be the same while the angles of the rearward orifices 134, 136 can be made to be equal.

In the rotating ultrasonic nozzle of FIG. 3E, the inside forward end 110 of the nozzle 100 is rounded (or shaped like a bell mouth) to provide the fluid dynamics required to generate forced pulsed waterjets through each of the four orifices. Likewise, the entry zones 120 proximal to each pair of exit orifices are also rounded or bell-mouthed for optimal flow into the orifices. In this four-orifice configuration, the erosive capacity of the forwardly angled waterjets (egressing through orifices 130, 132) is expected to be greater than that of the rearwardly angled waterjets (egressing through orifices 134, 136). Furthermore, the erosive capacity is a function of whether the nozzle is translating forward or backward. Thus, in an "in-and-out" cycle, an inner surface would be subjected (in the forward pass) to the forwardly angled jets and the rearwardly angled jets. In the backward pass, since the nozzle is traveling in the opposite direction, what were previously the rearwardly angled jets egressing through 134 and 136 thus become the forwardly angled jets while what were previously the forwardly angled jets egressing through 130 and 132 thus become the rearwardly angled jets. This nozzle presented in FIG. 3E is designed with exit orifices that have an optimal L/d ratio in the range of 2:1 to 0.5:1, and preferably about 1:1. This ratio of the length of the orifice (L) to its diameter (d) is very important in creating a usable forced pulsed waterjet at the correct power and standoff distance, which in turn, is crucial for achieving the desired surface finish or surface roughness. Another important parameter is the tip-to-orifice length 'a' which can be adjusted to generate an optimized forced pulsed waterjet. Optionally, the nozzle is designed by selecting a ratio D/d (where D is the diameter of the microtip) that optimizes performance. Applicants are believed to be the first to recognize the significance of these various parameters and their ratios on the ability of a forced pulsed waterjet to perform precise and predictable surface prepping. The effect of, and the interplay among, these various operating parameters are based on very extensive empirical data that has been collected by Applicants, a small collection of which is presented below to facilitate understanding of this novel technology.

FIG. 3F is a cross-sectional view of another example of a rotating four-orifice ultrasonic nozzle (this variant being designated by reference numeral 200) that can be used to prep an internal surface of a tubular structure. As depicted in FIG. 3F, this nozzle 200 has two forwardly angled orifices 212 and 222 (of diameters d1 and d4, respectively) and two rearwardly angled orifices 232 and 242 (of diameters d2 and d3, respectively). Each of these four orifices is formed at the end of a respective curved conduit as shown in FIG. 3F. Specifically, orifice 212 is disposed at the end of conduit 210, orifice 222 is disposed at the end of conduit 220, orifice 232 is disposed at the end of conduit 230, and orifice 242 is disposed at the end of conduit 240.

This nozzle 200 can be constructed by high-pressure welding of two high-pressure tubes that are first sliced as shown in this figure. The joining of these two sliced tubes produces a sharp bifurcation 250. Optionally, the nozzle can include orifice inserts that are secured into each curved conduit to provide the desired geometry at the exit of each curved conduit. The desired geometry is achieved by selecting the values of L and d to achieve an L/d ratio in the range of 2:1 to 0.5:1. Preferably, an L/d ratio of about 1:1 is believed to be optimal. Optionally, the nozzle is designed with a suitable value of 'a' (or values 'a' in the case of multiple orifices). The 'a' value is the distance from the microtip to each respective exit orifice. This 'a' value is crucial in ensuring that the pulses develop at the right distance from the nozzle, and thus has an important effect on the standoff distance. Optionally, the ratio D/d may also be configured to provide optimally pulsated waterjets. The value D is the diameter of the microtip. Thus, the ratio D/d is the ratio of the diameter of the microtip to the diameter of the exit orifice. This D/d is preferably in the range of about 1 to 1.5.

Figure 4:
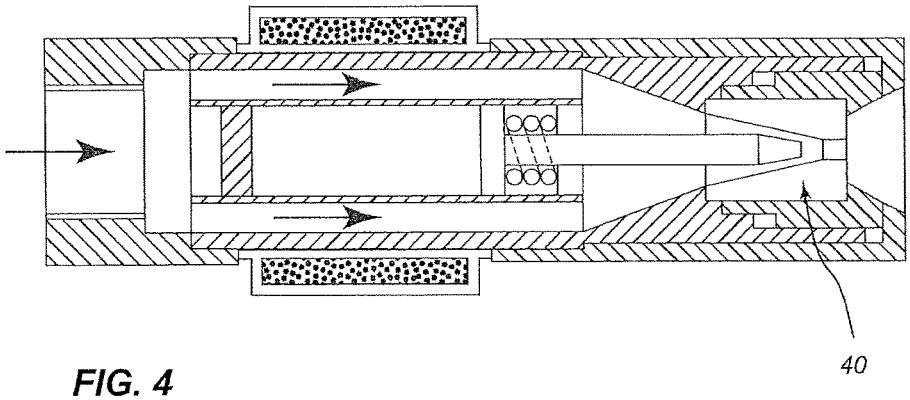
FIG. 4 is a cross-sectional view of an ultrasonic nozzle having a magnetostrictive cylindrical core.
Figure 5:
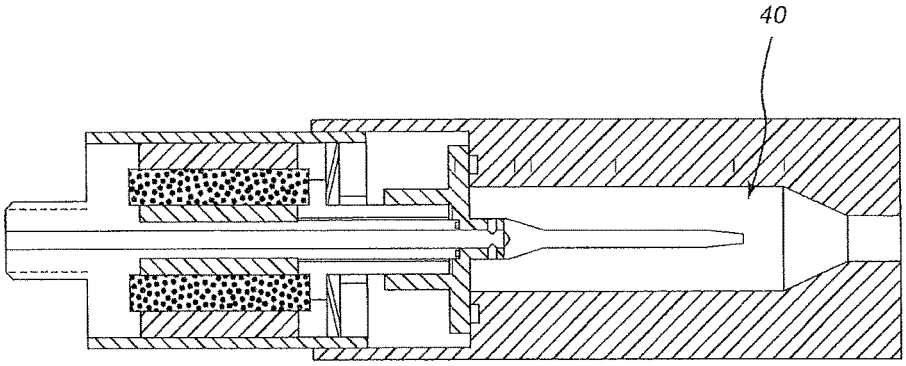
FIG. 5 is a cross-sectional view of an ultrasonic nozzle having a magnetostrictive tubular core.

Although the ultrasonic nozzle can employ a piezoelectric transducer, as shown in the nozzle of FIG. 1, the nozzle can also utilize a magnetostrictive transducer. FIG. 4 is a cross-sectional view of one example of an ultrasonic nozzle having a magnetostrictive cylindrical core. FIG. 5 is a cross-sectional view of another example of an ultrasonic nozzle having a magnetostrictive tubular core. The nozzles presented in FIG. 4 and FIG. 5 are described more fully in WO/2005/042177 (Vijay).

Method

The present technology also pertains to a novel method of prepping a surface using a high-frequency forced pulsed waterjet. The method comprises steps of generating a high-frequency signal having a frequency f (e.g. 5-40 kHz) using a high-frequency signal generator and applying the high-frequency signal to a transducer (e.g. a piezoelectric transducer or a magnetostrictive transducer) having a microtip (or "probe") to cause the microtip of the transducer to oscillate (vibrate) to thereby generate a forced pulsed waterjet through an exit orifice of a nozzle having an exit orifice diameter d. The forced pulsed waterjet is caused to impinge upon the surface to be prepped (i.e. the target material) to prepare the surface (of the target material) to within a predetermined range of surface roughness, wherein the predetermined range of surface roughness is determined by selecting operating parameters comprising a standoff distance (SD), a traverse velocity $V_{TR}$ of the nozzle, a water pressure P, a water flow rate Q, a length-to-diameter (L/d) ratio, where L represents a length of the cylindrical portion of the exit orifice, a parameter 'a' representing a distance from the microtip to the exit plane of the exit orifice, the frequency f, and an amplitude A of the high-frequency signal.

Preferably, the L/d ratio is between 2:1 and 0.5:1. For example, excellent results have been achieved with an L/d ratio of 2:1, or with an L/d ratio of 0.5:1. However, best results have been achieved with an L/d ratio of 1:1.

The standoff distance (SD) is preferably no greater than 10.0" (25.4 cm) and, more preferably, between 0.5" (1.27 cm) to 5.0" (12.7 cm). The standoff distance is optimal where the slugs are fully formed. A standoff distance that is too small will be inferior since the pulses have not had enough time to form. Likewise, a standoff distance that is too large will be inferior since the pulses will begin to dissipate due to due aerodynamic forces acting on the slugs. Thus, an optimal SD is instrumental in achieving the desired surface prepping results.

Preferably, the exit orifice diameter d is between 0.020" and 0.500", and, more preferably, between 0.040" and 0.065". For example, excellent results have been achieved with the exit orifice diameter d=0.040", or d=0.050", or d=0.054" or d=0.065". A single orifice can be used. Alternatively, dual-orifice or multiple-orifice nozzles can be used. These nozzles can furthermore (optionally) be made to rotate.

The water pressure is preferably between 1000 (6.9 MPa) and 20,000 psi (138 MPa) and, more preferably, between 5000 psi (34.5 MPa) and 10,000 psi (69 MPa). As will be appreciated, lower or higher pressures can be used although, preferably, pressures are not to exceed 20 kpsi (138 MPa) since the problems associated with UHP (ultra-high pressure jets) begin to manifest themselves.

Optionally, the nozzle can be configured to have a specific ratio D/d where D represents a diameter of the microtip and d represents (as noted above) the diameter of the exit orifice. It has been found that a ratio D/d around 1 provides excellent performance, although very good results are still achieved if the ratio D/d range anywhere from about 1 to 1.5.

As was noted above in the preceding section describing the novel ultrasonic waterjet apparatus, this novel method can be used on either metallic or non-metallic surfaces of any shape or size to achieve a particular surface finish or surface roughness. By selecting the operating parameters, a uniform and predictable surface finish can be achieved. In other words, this surface finish is predetermined by the various operating conditions and by the geometry of the nozzle, i.e. it is reproducible, controllable and predictable. In one specific implementation, the FPWJ can be used to create patterns in rock, marble, granite, masonry, or any other rock-like surface. This novel application of FPWJ enables surface cutting, surface decorating and forming. Using this technique, it is possible to inscribe letters, numbers, symbols, words, patterns, shapes, etc. in a rock-like material.

Drop-Test

As alluded to above with respect to FIG. 1B, the interrelationships among the various operating parameters are computationally extremely complex. A simple and effective technique has thus been developed by Applicants to determine appropriates values, settings, configurations and ranges for generating a forced pulsed waterjet that is specifically tailored to produce a given surface finish on a given material surface.

Figure 6:
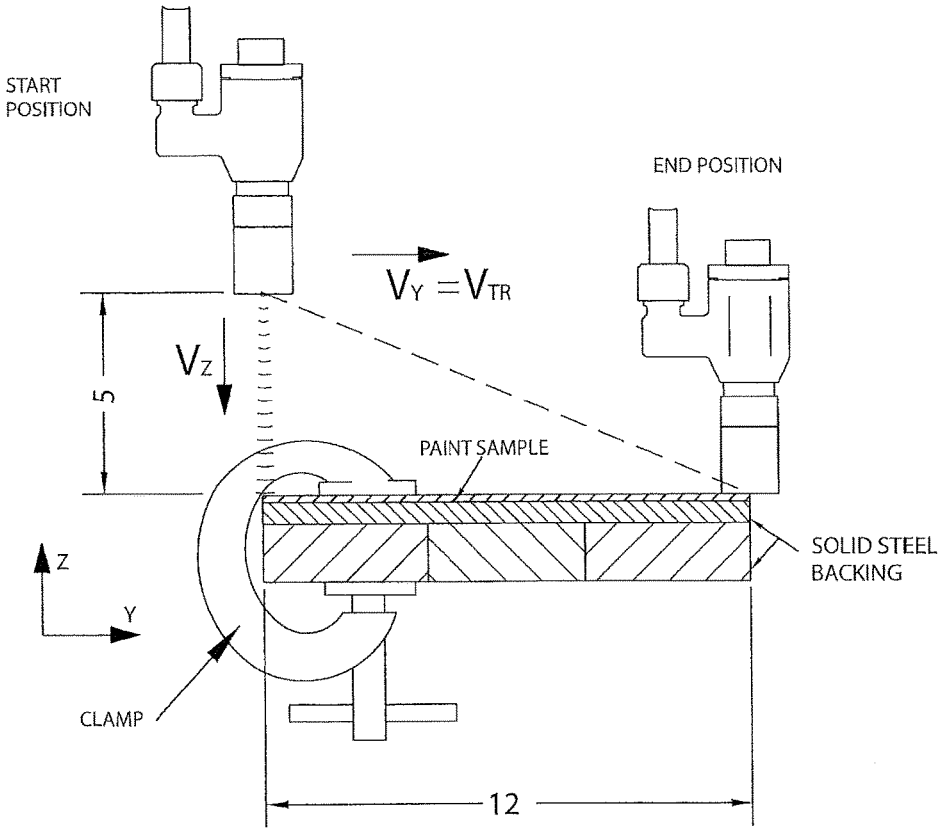
FIG. 6 is a side elevation view of an experimental setup used to conduct a "dual-motion test" (also referred to herein as a "drop test") for determining the effect of various operating parameters on coating removal, surface preparation and material removal (erosion)
Figure 7:
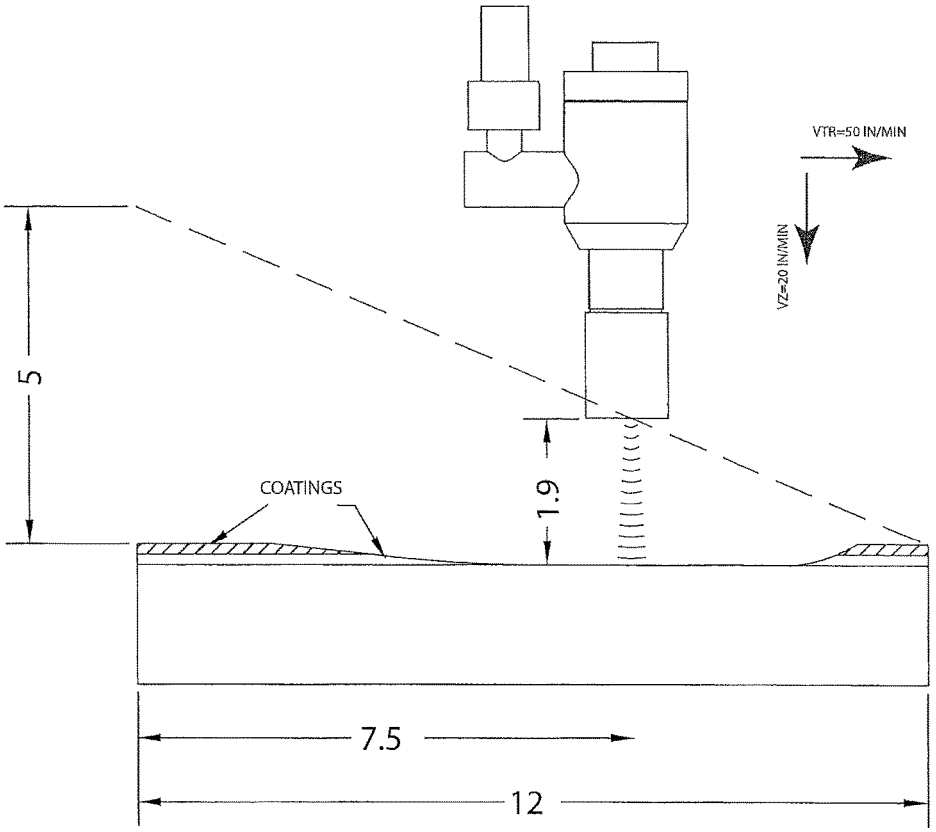
FIG. 7 is a side elevation view of the setup shown in FIG. 6 in the midst of conducting the dual-motion test.
Figure 8:
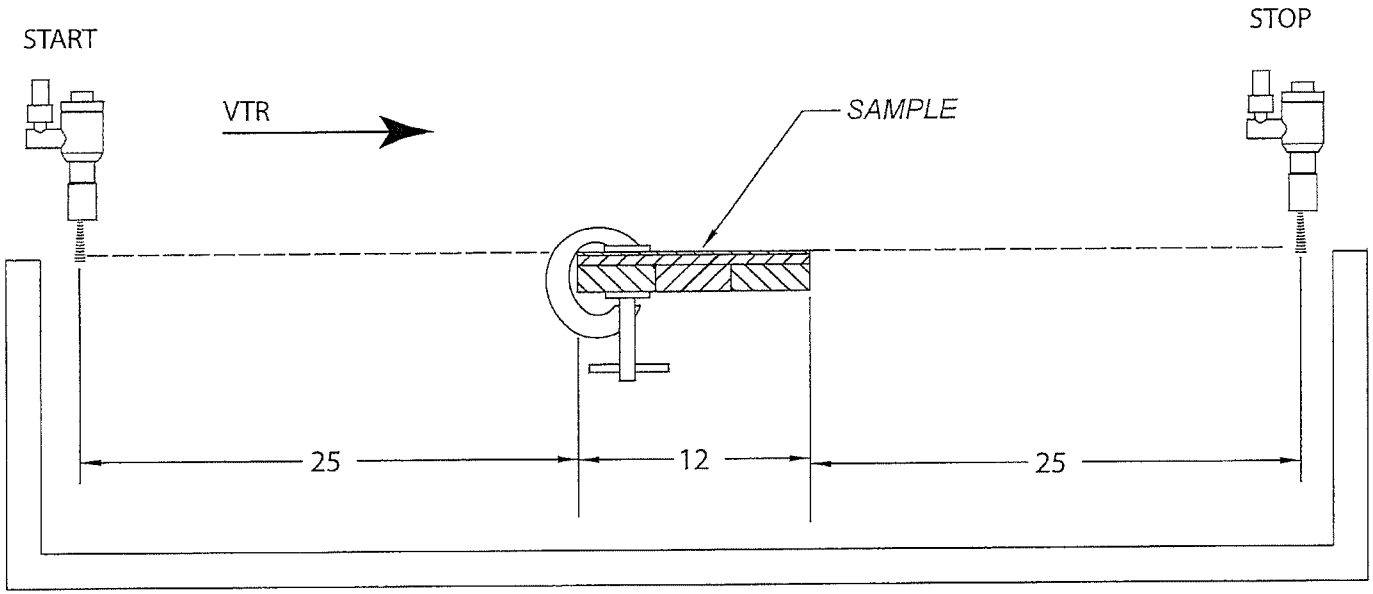
FIG. 8 is a side elevation view of a "speed test" depicting how the jet is run over the coating until the coating no longer comes off or until the gantry carrying the ultrasonic nozzle has reached its maximum designed speed.

The experimental setup for conducting this unique so-called "drop-test" ("dual-motion test") is depicted in a side elevation view in FIG. 6. As will be elaborated below, this novel test enables a user to determine the effect of various operating parameters on the removal of coatings with damage to the substrate (which is not acceptable), removal of coatings without damage and good finish of the substrate material and material removal or erosion (rate of mass loss). As shown in FIG. 6, the nozzle is moved simultaneously in a vertically downward (or upward) direction at velocity Vz and in a horizontal direction at the traverse velocity $V_{TR}$. Because the nozzle drops vertically downward (or rises vertically upward) as it traverses horizontally, this is said to be a "drop test". In general, though, the test can be performed by simultaneously varying the vertical standoff distance as the nozzle is displaced transversely, hence the other name "dual motion" test. FIG. 7 is a side elevation view of the setup shown in FIG. 6 in the midst of conducting the drop test (dual-motion test). The purpose of the drop test is to find out in the order of importance: 1) Determine the optimal standoff distance SD; 2) Determine the effective zone; 3) Determine the jet behaviour with different values; and 4) Determine the jet behaviour with different pressures. In one example of this drop test, the nozzle position is varied from a maximum value of 5" (12.7 cm) to a minimum value of 0" (0 cm). Within this range an optimal standoff distance (SD) emerges which is then used for the FPWJ in actual coating removal or prepping applications.

Results of a particular set of drop tests (dual motion tests) are presented visually in FIGS. 9-24. This particular set of drop tests were performed using single jet nozzles of diameters 0.040", 0.050", 0.054", and 0.065", operating at pressures of either 5000 psi or 10,000 psi. The tip-to-orifice distance "a" was varied by turning a nut in discrete number of turns to effectively adjust the "a" parameter and thus to determine the effect of "a" on a number of key performance characteristics i.e. standoff distance, jet penetrating power, ultrasonic power consumption. The effect of varying the L/d ratio (ranging between 2:1 and 0.5:1) was also determined using these drop tests. For these tests, a 1.5-kW ultrasonic generator was used with its amplitude set at 50% of its maximum rated amplitude. For this group of drop-tests, the sample was 12" (30 cm) long and 1.5" inches (3.8 cm) wide with a thickness of ⅛" (3.2 mm) that is cut into strips. The 2.0-mm thick coating consisted of a white primer, Red Devoe anti-fouling top coating (International Marine Paint prepared by RLD) on a sandblasted base metal to 2-3 mm.

This drop test uses the motor-controlled Z-axis to drop the nozzle height at a constant speed (measured 20 in/min) in combination with the Y-axis motion to move the nozzle position laterally at a constant speed. By knowing these two speeds, a sample type and length was selected to best illustrate the power of the pulse jet over a short distance, to give clear and conclusive evidence of its performance characteristics.

In this setup, the jet was set at the desired pressure with pulse on and the initial standoff distance (SD) set at 5" (12.7 cm). The movement along both the Y axis and the Z axis has to be activated simultaneously so that the nozzle moves forward as its vertical position is being continually lowered until the jet leaves the sample surface. Thus, the nozzle is travelling at a diagonal path from SD=5" to SD=0" (i.e. 12.7 cm to 0 cm). Essentially, the "drop-test" method confirms the existence of four zones (L1, L2, L3 and L4) of the pulsed waterjet as illustrated in FIG. 1B. Thus, this simple test will show the range of effective standoff distances. At some point in between this end position, the jet displays its most intense pulse jet power on the sample surface in terms of coating and base material erosion. This power also has a discrete lateral zone which translates into the range of effective standoff distances (SD). Within one single pass the test will show the exact location and duration of the impact zone with respect to the overall length of the sample which translates into effective standoff distances and range. One can also inspect for surface erosion marks and swath width coverage for power evaluation, nozzle geometry and characteristics it leaves on the sample.

By performing this drop test not only is it easier and faster, and more accurate but it also tells a complete story of the jet's profile and characteristics of when the pulse forms and diminishes without having to rely on high-speed photography analysis.

Once the optimum parameter has been determined, a peak performance test (see FIG. 8) has to be established by running the jet over the coating until the coating no longer comes off or until the gantry carrying the nozzle has reached its maximum designed speed. This "speed test" starts the nozzle from the back of the gantry and ends at the front with the sample placed in the middle to account for acceleration of the gantry.

The drop test therefore provides a useful and novel means to determine operating parameters for particular prepping or coating-removal applications. In broad terms, this method can be summarized as entailing steps of restraining a sample material, setting a transverse velocity for the nozzle, and varying the vertical distance between the nozzle and the material while horizontally displacing the nozzle transversely relative to the material (i.e. at the transverse velocity). This optimal standoff distance SD can thus be determined by observing the effect of the jet on the material sample. Subsequently, other useful ranges of parameters (e.g. "a" values and operating pressures can be determined). It should be noted that the drop test can be used not only for a single jet but also for any type of pulse jet, e.g. rotating, fan jets, RF cavitation, etc.

The visual results of this particular group of drop-tests (dual-motion tests) are presented in FIGS. 9 to 24 by way of example only.

Figure 9:
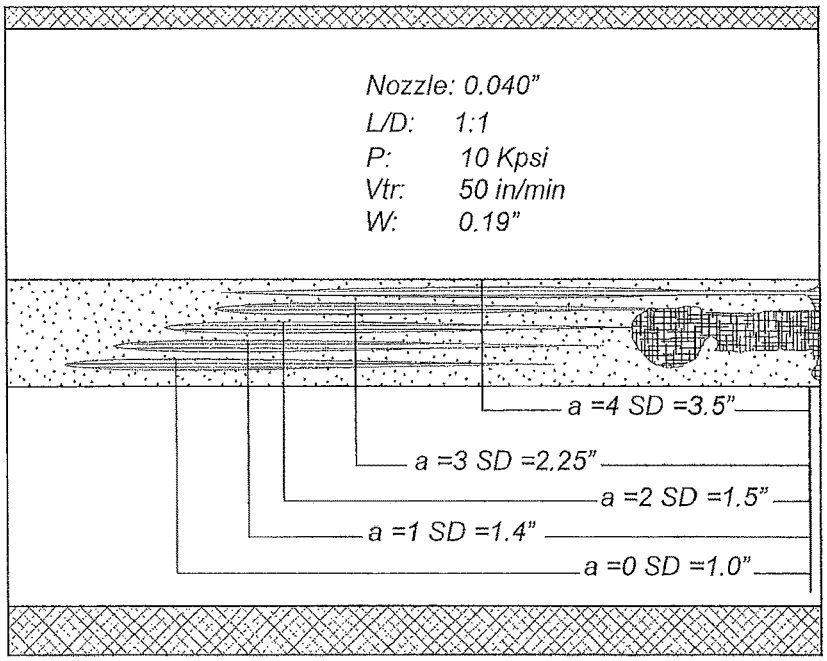
FIG. 9 is a representation of test results of removal of two-layered epoxy coating from a steel strip obtained with a 0.040"-diameter nozzle with an L/d ratio of 1:1, a pressure P=10 kpsi, and $V_{TR}$=50 in/min (127 cm/min)

FIG. 9 is a representation of test results for a 0.040"-diameter nozzle with an L/d ratio of 1:1, a pressure P=10 kpsi (69 MPa), and $V_{TR}$=50 in/min (127 cm/min). The 'a' values were varied as were the SD values. SD values were varied between 1.0" and 3.5" (2.54 cm to 8.89 cm). The following explanation indicates the usefulness of the "drop-test method. For the given set of operating parameters, one can evaluate the effect of changing the value of 'a' from 0 turns to 4 turns by examining (1) the maximum width of the swath removed and (2) the maximum degree of erosion of the substrate. In the case of removal of coatings, the desired extent of erosion is equivalent to the profile generated by grit blasting prior to coating. In the case of removal of material, for example, removal of concrete from roadways, the maximum degree of erosion is highly desirable. And, in the case of creating architectural patterns, the degree of erosion required is dependent upon the depth to which the patterns need to be created. In the case of removal of coatings, the damage to the substrate can be eliminated either by increasing VTR (which also enhances the productivity) or, changing the SD. With respect to visual observation of the swaths in FIG. 9, for the case of a=0 turns, the maximum width of removal seems to occur at SD=1.0" (2.54 cm). If this is the desirable SD, then slight damage to the substrate can be eliminated by increasing VTR from 50 in/min (127 cm/min) to say 60 in/min (152 cm/min). Continuing the observations, for a=4 turns, the maximum width seems to occur at SD=3.5" (8.89 cm). If this is the desirable SD, then simply setting a=4 turns, the coating can be removed without damage to the substrate. Thus, simply by changing the value of 'a', for a given set of operating parameters, the process of removal of the coating and productivity can be controlled. Similar observations apply to all the results depicted in FIGS. 10 to 24.

Figure 10:
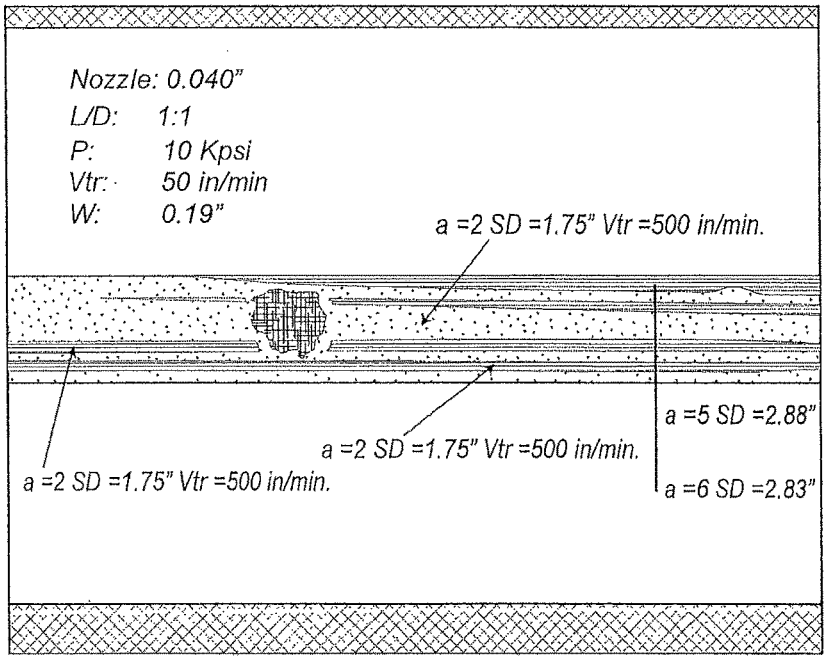
FIG. 10 is a representation of test results for a 0.040"-diameter nozzle with an L/d ratio of 1:1, a pressure P=10 kpsi, and $V_{TR}$=50 in/min (127 cm/min) but for different "a" values and for different standoff distances.

FIG. 10 is a representation of test results for a 0.040"-diameter nozzle with an L/d ratio of 1:1, a pressure P=10 kpsi (69 MPa), and $V_{TR}$=50 in/min (127 cm/min) but for different "a" values and for different standoff distances.

Figure 11:
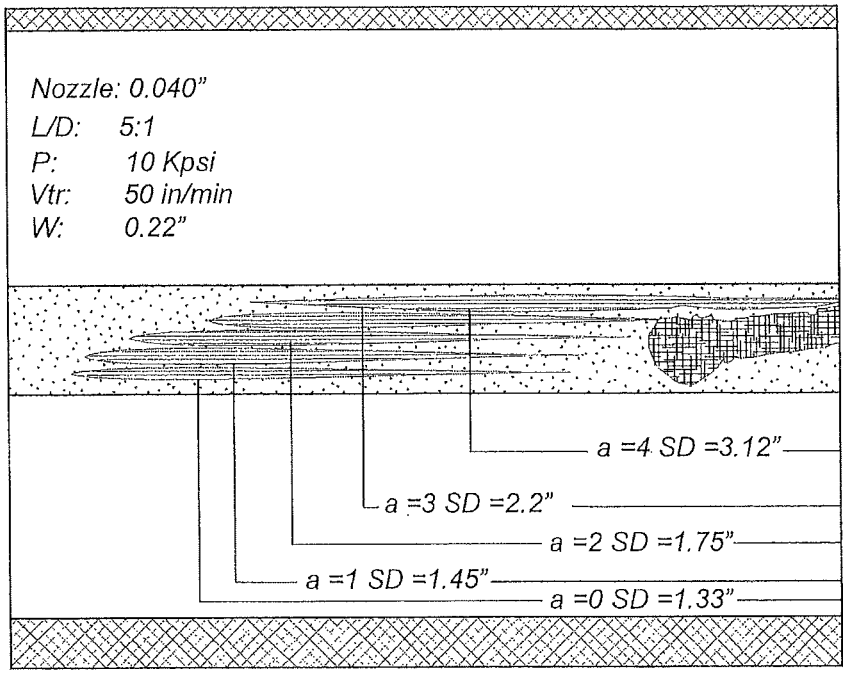
FIG. 11 is a representation of test results for a 0.040"-diameter nozzle with an L/d ratio of 0.5:1, a pressure P=10 kpsi, and $V_{TR}$=50 in/min (127 cm/min)

FIG. 11 is a representation of test results for a 0.040"-diameter nozzle with an L/d ratio of 0.5:1, a pressure P=10 kpsi (69 MPa), and $V_{TR}$=50 in/min (127 cm/min). The 'a' values were varied as were the standoff distances.

Figure 12:
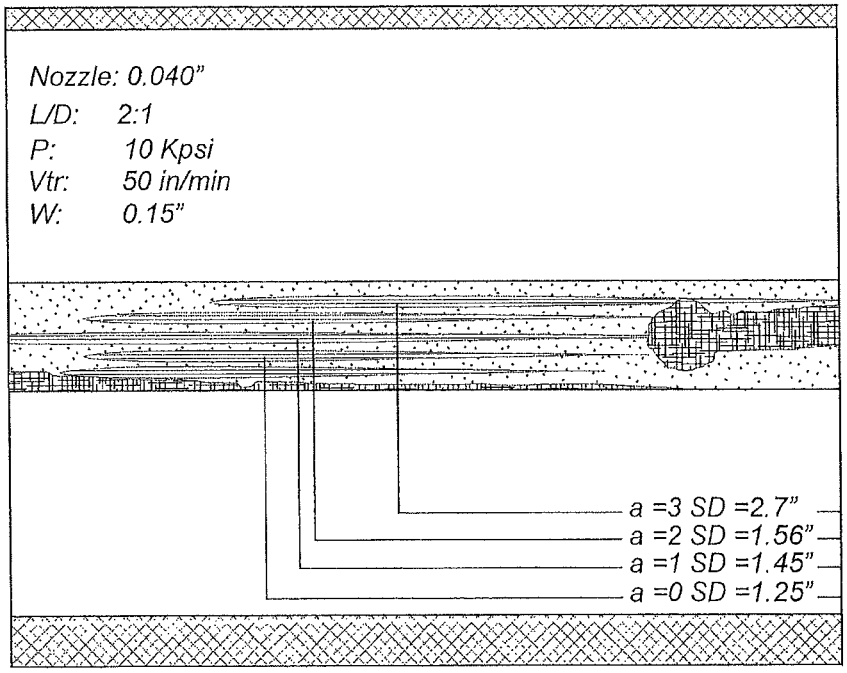
FIG. 12 is a representation of test results for a 0.040"-diameter nozzle with an L/d ratio of 2:1, a pressure P=10 kpsi, and $V_{TR}$=50 in/min (127 cm/min)

FIG. 12 is a representation of test results for a 0.040"-diameter nozzle with an L/d ratio of 2:1, a pressure P=10 kpsi (69 MPa), and $V_{TR}$=50 in/min (127 cm/min). Again, the 'a' was varied.

Figure 13:
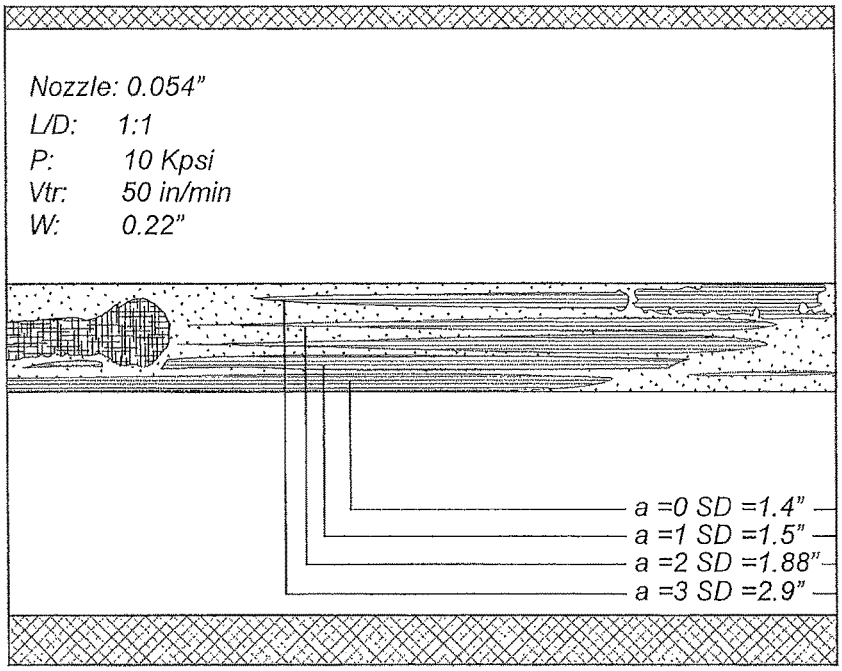
FIG. 13 is a representation of test results for a 0.054"-diameter nozzle with an L/d ratio of 1:1, a pressure P=10 kpsi, and $V_{TR}$=50 in/min (127 cm/min)

FIG. 13 is a representation of test results for a 0.054"-diameter nozzle with an L/d ratio of 1:1, a pressure P=10 kpsi (69 MPa), and $V_{TR}$=50 in/min (127 cm/min). Again, the 'a' was varied.

Figure 14:
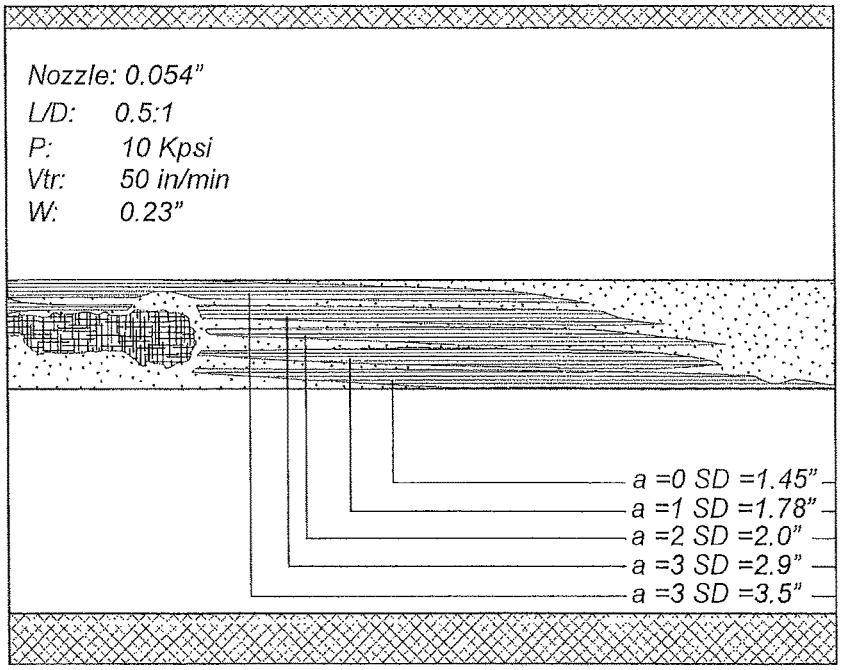
FIG. 14 is a representation of test results for a 0.054"-diameter nozzle with an L/d ratio of 0.5:1, a pressure P=10 kpsi, and $V_{TR}$=50 in/min (127 cm/min)

FIG. 14 is a representation of test results for a 0.054"-diameter nozzle with an L/d ratio of 0.5:1, a pressure P=10 kpsi (69 MPa), and $V_{TR}$=50 in/min (127 cm/min). Again, the 'a' was varied.

Figure 15:
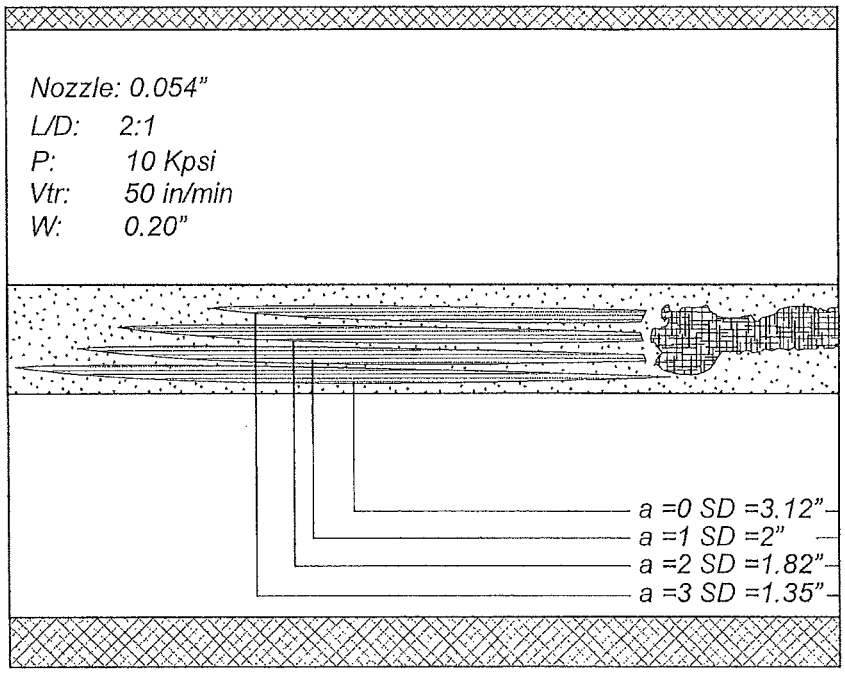
FIG. 15 is a representation of test results for a 0.054"-diameter nozzle with an L/d ratio of 2:1, a pressure P=10 kpsi, and $V_{TR}$=50 in/min (127 cm/min)

FIG. 15 is a representation of test results for a 0.054"-diameter nozzle with an L/d ratio of 2:1, a pressure P=10 kpsi (69 MPa), and $V_{TR}$=50 in/min (127 cm/min). Again, the 'a' was varied.

Figure 16:
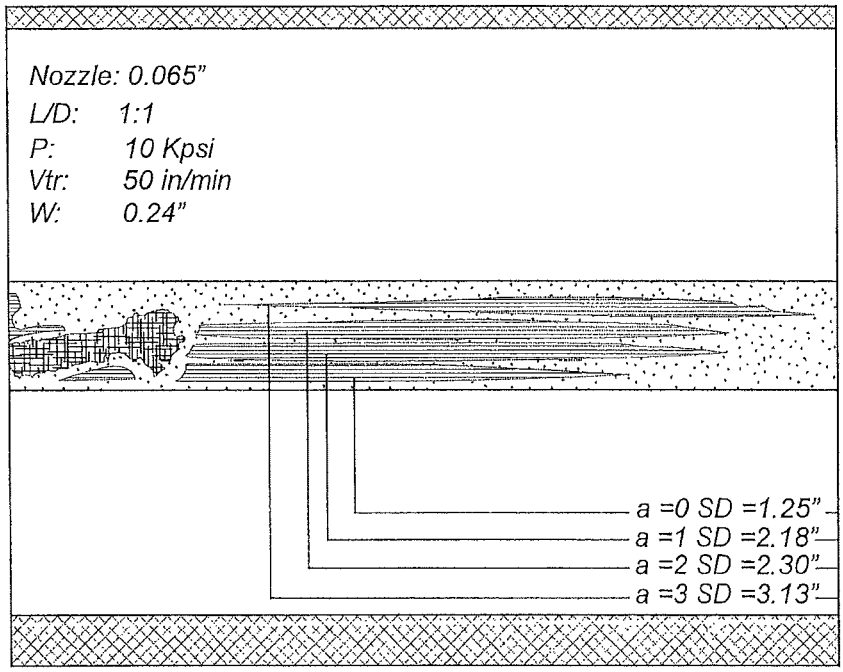
FIG. 16 is a representation of test results for a 0.065"-diameter nozzle with an L/d ratio of 1:1, a pressure P=10 kpsi, and $V_{TR}$=50 in/min (127 cm/min)

FIG. 16 is a representation of test results for a 0.065"-diameter nozzle with an L/d ratio of 1:1, a pressure P=10 kpsi (69 MPa), and $V_{TR}$=50 in/min (127 cm/min). Again, the 'a' values were varied.

Figure 17:
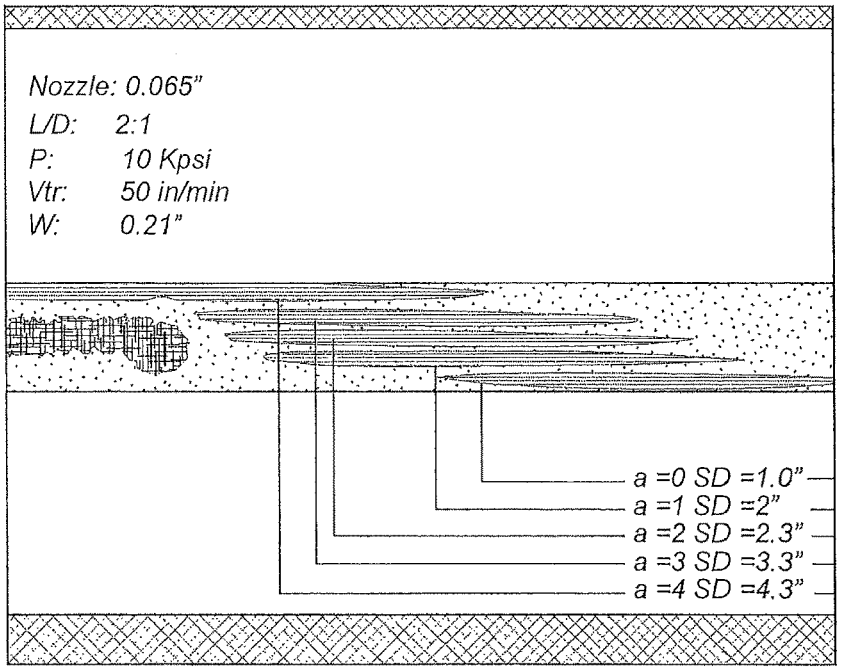
FIG. 17 is a representation of test results for a 0.065"-diameter nozzle with an L/d ratio of 2:1, a pressure P=10 kpsi, and $V_{TR}$=50 in/min (127 cm/min)

FIG. 17 is a representation of test results for a 0.065"-diameter nozzle with an L/d ratio of 2:1, a pressure P=10 kpsi (69 MPa), and $V_{TR}$=50 in/min (127 cm/min). Again, the 'a' values were varied.

Figure 18:
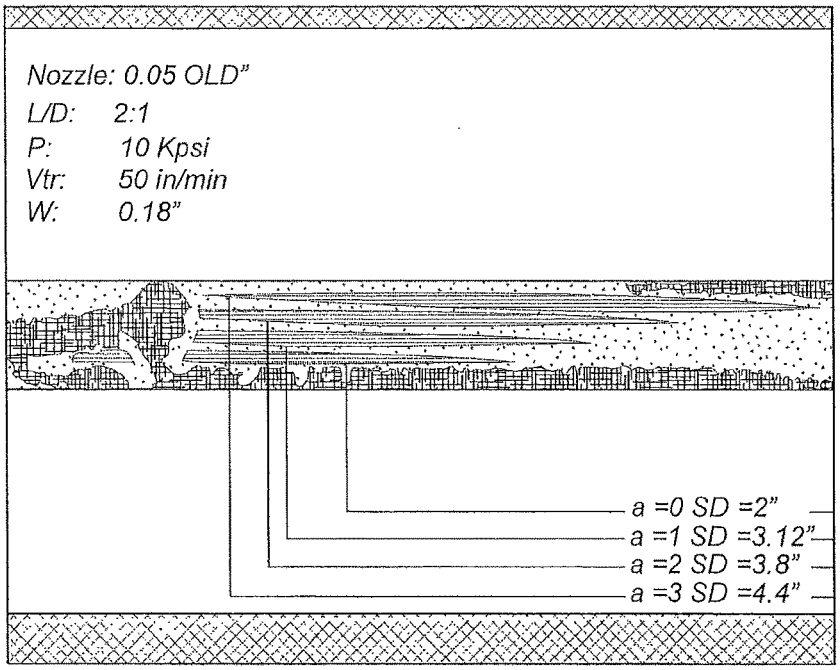
FIG. 18 is a representation of test results for a 0.050"-diameter nozzle with an L/d ratio of 2:1, a pressure P=10 kpsi, and $V_{TR}$=50 in/min (127 cm/min)

FIG. 18 is a representation of test results for a 0.050"-diameter nozzle with an L/d ratio of 2:1, a pressure P=10 kpsi (69 MPa), and $V_{TR}$=50 in/min (127 cm/min). Again, the 'a' values were varied.

Figure 19:
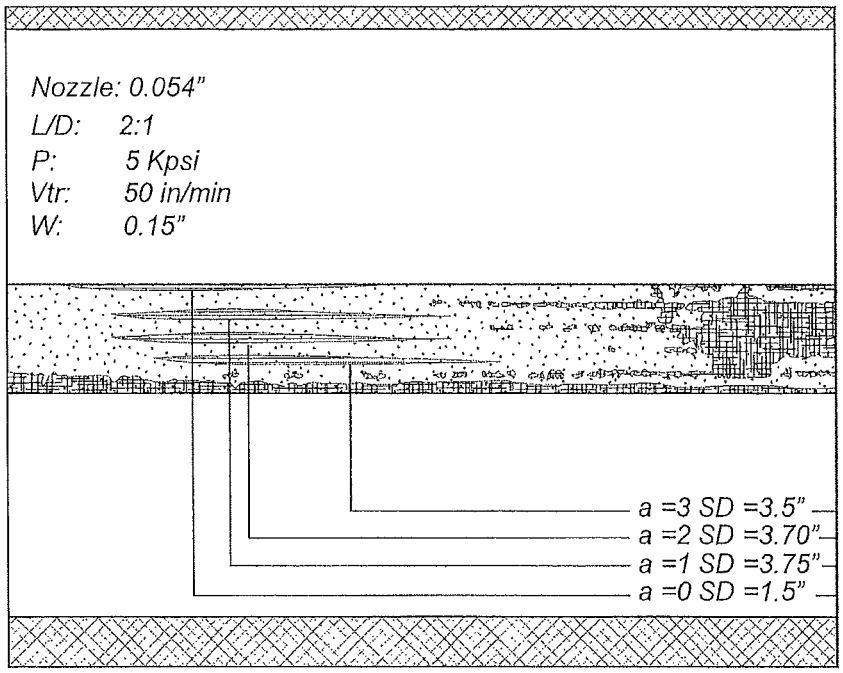
FIG. 19 is a representation of test results for a 0.054"-diameter nozzle with an L/d ratio of 2:1, a pressure P=5 kpsi, and $V_{TR}$=50 in/min (127 cm/min)

FIG. 19 is a representation of test results for a 0.054"-diameter nozzle with an L/d ratio of 2:1, a pressure P=5 kpsi (34 MPa), and $V_{TR}$=50 in/min (127 cm/min). Again, the 'a' values were varied.

Figure 20:
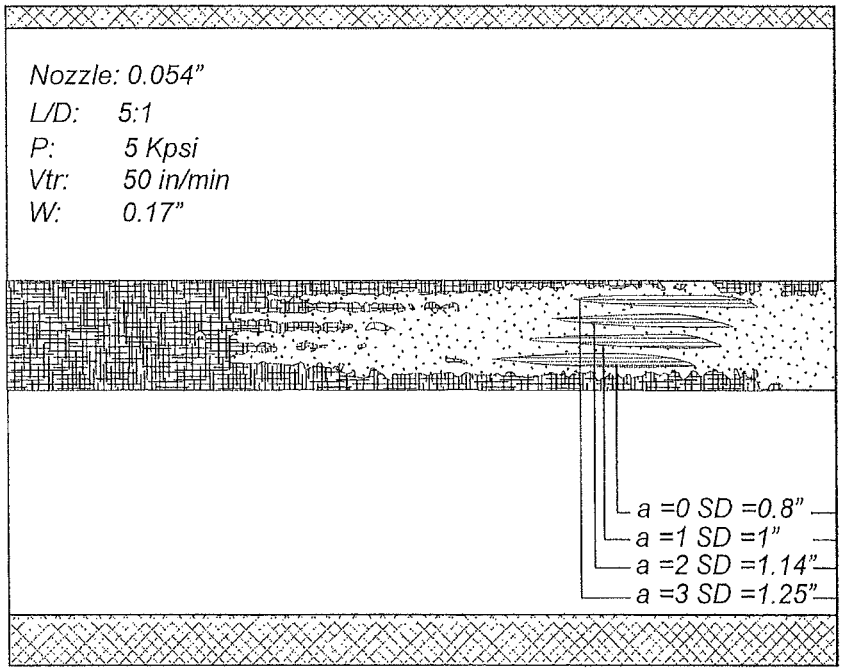
FIG. 20 is a representation of test results for a 0.054"-diameter nozzle with an L/d ratio of 0.5:1, a pressure P=5 kpsi, and $V_{TR}$=50 in/min (127 cm/min)

FIG. 20 is a representation of test results for a 0.054"-diameter nozzle with an L/d ratio of 0.5:1, a pressure P=5 kpsi (34 MPa), and $V_{TR}$=50 in/min (127 cm/min). Again, the 'a' values were varied.

Figure 21:
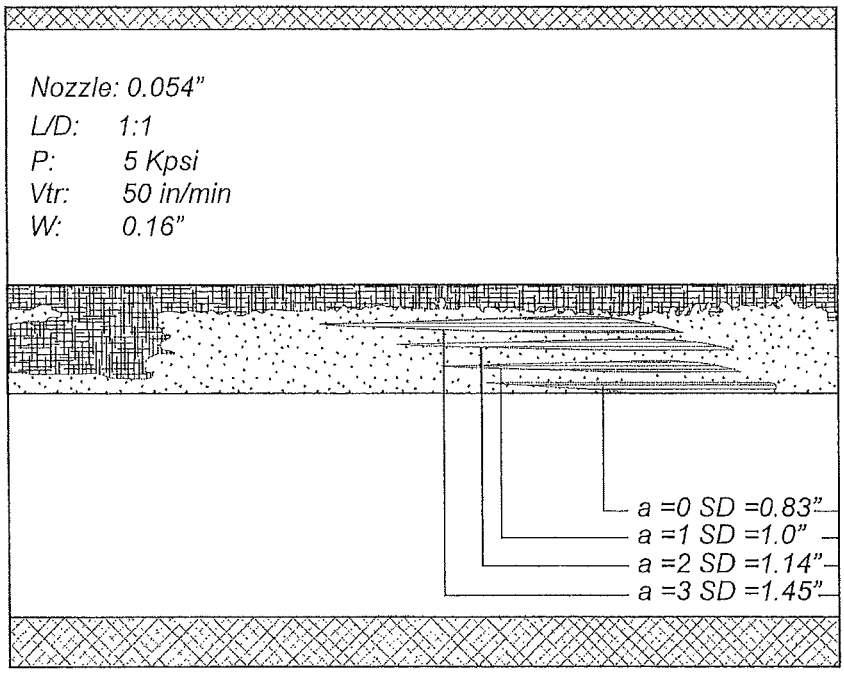
FIG. 21 is a representation of test results for a 0.054"-diameter nozzle with an L/d ratio of 1:1, a pressure P=5 kpsi, and $V_{TR}$=50 in/min (127 cm/min)

FIG. 21 is a representation of test results for a 0.054"-diameter nozzle with an L/d ratio of 1:1, a pressure P=5 kpsi (34 MPa), and $V_{TR}$=50 in/min (127 cm/min).

Figure 22:
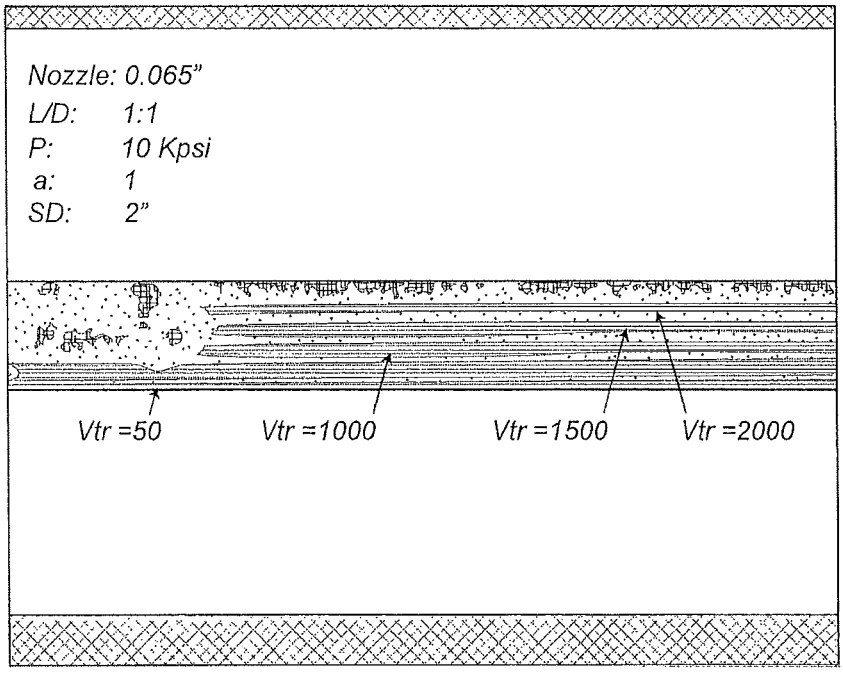
FIG. 22 is a representation of test results for a 0.065"-diameter nozzle with an L/d ratio of 1:1, a pressure P=10 kpsi, an "a" value of 1, a standoff distance of 2" and $V_{TR}$ values of 50, 1000, 1500 and 2000 in/min.

FIG. 22 is a representation of test results for a 0.065"-diameter nozzle with an L/d ratio of 1:1, a pressure P=10 kpsi (69 MPa), an "a" value of 1, a standoff distance of 2" and $V_{TR}$ values of 50, 1000, 1500 and 2000 in/min, i.e. 1.27 m/min, 25.4 m/min, 38.1 m/min and 50.8 m/min, respectively.

Figure 23:
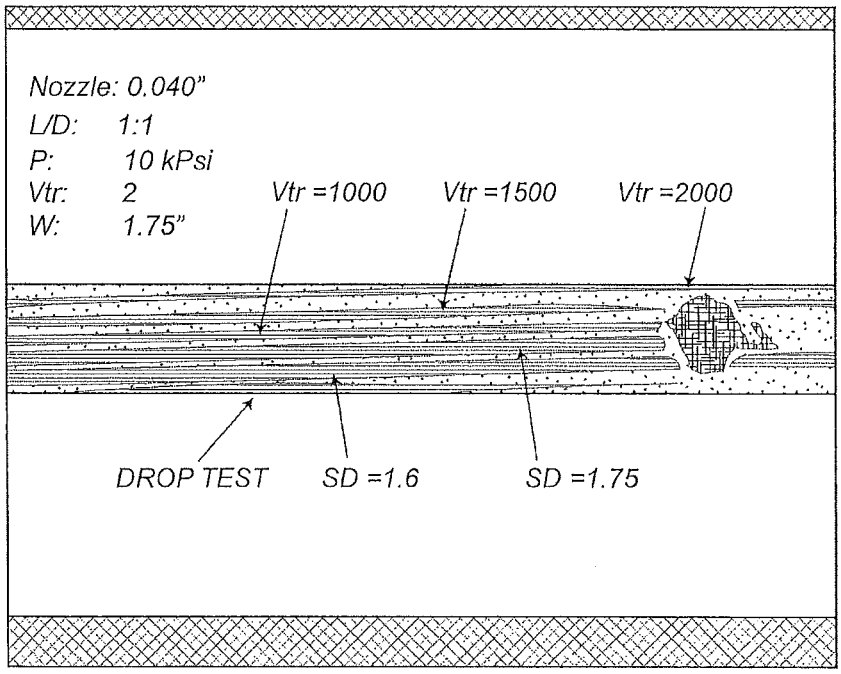
FIG. 23 is a representation of test results for a 0.040"-diameter nozzle with an L/d ratio of 1:1, a pressure P=10 kpsi, an "a" value of 2, standoff distances of 1.6" and 1.75" and $V_{TR}$ values of 1000, 1500 and 2000 in/min.

FIG. 23 is a representation of test results for a 0.040"-diameter nozzle with an L/d ratio of 1:1, a pressure P=10 kpsi (69 MPa), an "a" value of 2, standoff distances of 1.6" and 1.75" and $V_{TR}$ values of 1000, 1500 and 2000 in/min, i.e. 25.4 m/min, 38.1 m/min and 50.8 m/min, respectively.

Figure 24:
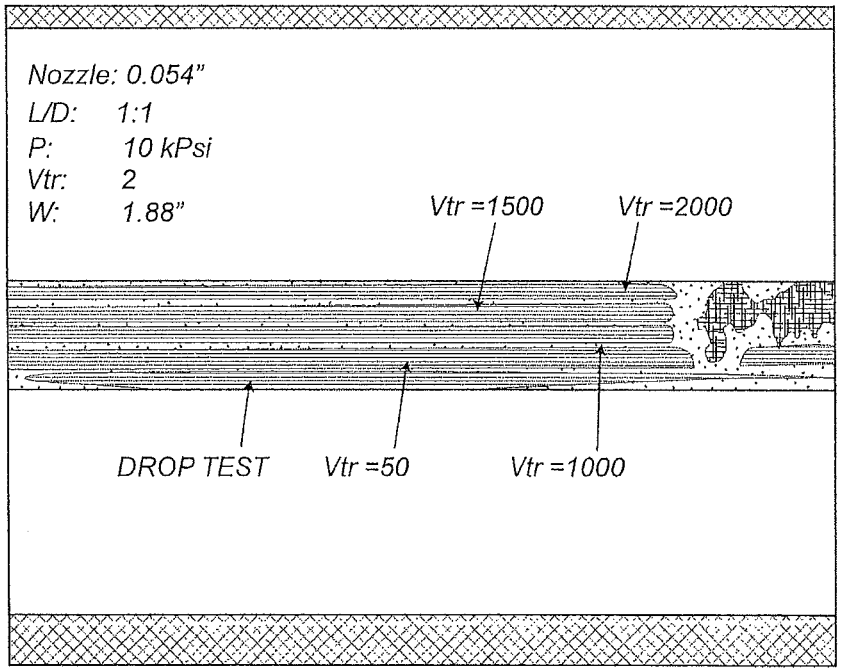
FIG. 24 is a representation of test results for a 0.054"-diameter nozzle with an L/d ratio of 1:1, a pressure P=10 kpsi, an "a" value of 2, a standoff distance of 1.88" and $V_{TR}$ values of 50, 1000, 1500 and 2000 in/min.

FIG. 24 is a representation of test results for a 0.054"-diameter nozzle with an L/d ratio of 1:1, a pressure P=10 kpsi (69 MPa), an "a" value of 2, a standoff distance of 1.88" and $V_{TR}$ values of 50, 1000, 1500 and 2000 in/min, i.e. 1.27 m/min, 25.4 m/min, 38.1 m/min and 50.8 m/min, respectively.

Figure 25:
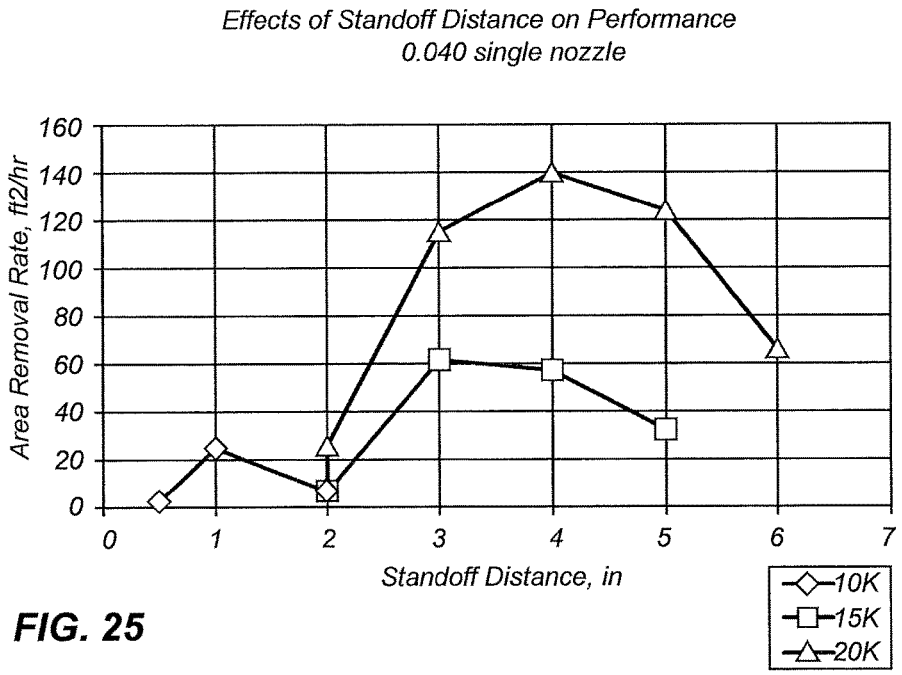
FIG. 25 is a graph plotting area removal rate versus standoff distance for three operating pressures, 10 kpsi, 15 kpsi and 20 kpsi.

FIG. 25 shows a plot of area removal rate versus standoff distance for three operating pressures, 10 kpsi (69 MPa), 15 kpsi (103 MPa) and 20 kpsi (138 MPa). As observed in these plots, when the pressure is increased from 10 kpsi (69 MPa) to 20 kpsi (138 MPa), which represents a factor of 2, the removal rate increases from 21 to 139 square feet per hour, i.e. 1.95 $m^2$/hr to 12.91 $m^2$/hr (a factor of almost 7) even though the hydraulic power is increased only by a factor of 2.8. The specific energy (energy consumed by unit area of removal) decreased by 57%. This observation clearly indicates that removing the coatings at higher pressures improves the performance significantly. The second most important observation is that the optimum standoff distance (SD) at which removal rate is maximal increased from 1 to 4 inches (2.54 to 10.16 cm). This is very important for applications where accessibility is a problem due to size in the nozzle body. This increase in SD occurs for two reasons: 1) the breakup length increases with the pressure. As shown in FIG. 1B, the zone of well-defined pulses (L3) occurs at larger SDs; and 2) the diameter of the pulse increases with pressure also. Accordingly, the operating pressure P can range anywhere from 1 kpsi to 20 kpsi, i.e. 6.9 MPa to 138 MPa.

Based on these parameters, and again with reference to the drop test results, a suitable "a" value (an appropriate tip-to-orifice exit plane distance) would be selected. This "a" value partially determines the internal geometry of the ultrasonic nozzle to be used for this specific application. Furthermore, the jet behaviour is a function of other aspects of the nozzle geometry, namely the L/d ratio and the D/d ratio, both of which can be configured to provide optimal surface prepping. In addition, parameters such as pressure (P), flow rate (Q), frequency (f) and amplitude can be adjusted to achieve the best results possible for the desired surface finish.

Figure 26:
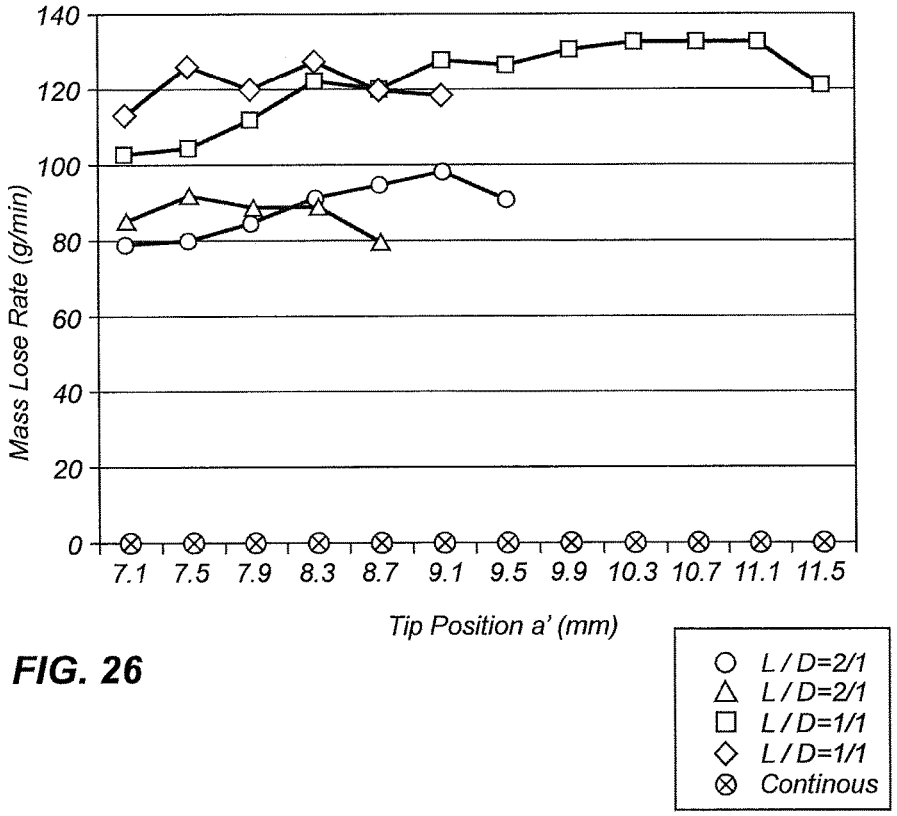
FIG. 26 is a graph plotting mass loss versus tip position ('a') for two different L/D ratios.

FIG. 26 is a graph plotting mass loss versus tip position ('a') for two different L/d ratios (namely L/d=2/1 and L/d=1/1). FIG. 26 thus shows that the orifice L/d ratio=1 is better than L/d=2 for all values of 'a'. The surface finish of the inner surface of the orifice also influences the results. This is because a rough surface generates turbulence which is detrimental to producing a coherent jet (i.e. it rips the outer circumferential surfaces of the jet as it emerges into the air, thus dissipating its power). Thus, a well polished surface finish is important for producing a good jet.

FIG. 26 also shows that the position of the microtip (probe), which is represented by variable 'a', influences the performance. For example, the mass loss increases from about 100 g/min to about 130 g/min as the value of 'a' is increased from 0.28 to 0.39 inches, or 0.71 cm to 0.99 cm, i.e. $\Delta a$=0.11 in (0.28 cm). In practice, the optimal 'a' value (or range of 'a' values) can be determined by conducting drop tests on a comparable material. The mass loss is used as a performance indicator.

FIG. 26 also indicates that the mass removal by a continuous waterjet was measured to be zero (negligible). This is represented by the diamond symbols that are plotted right along the x-axis.

Figure 26A:
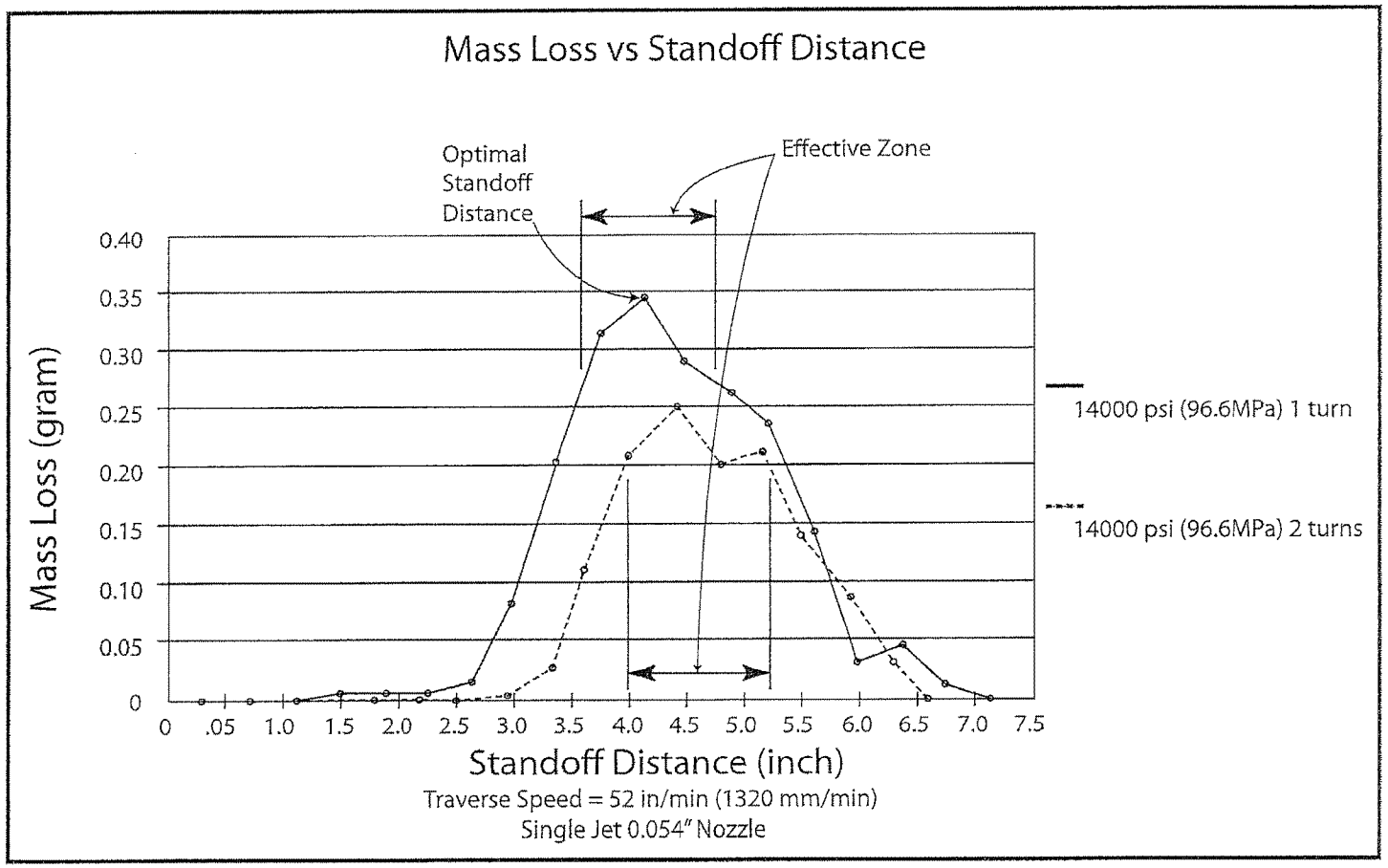
FIG. 26A is a plot of mass loss as a function of standoff distance at a constant pressure and two different values of 'a'.
Figure 27:
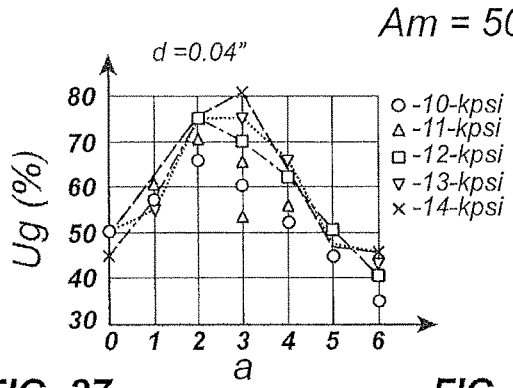
FIG. 27 is a graph plotting ultrasonic power consumed (percent of the rated power of ultrasonic generator for various pressures ranging from 10 kpsi to 14 kpsi) versus tip-to-orifice distance 'a' for d=0.040" and A=50%.
Figure 28:
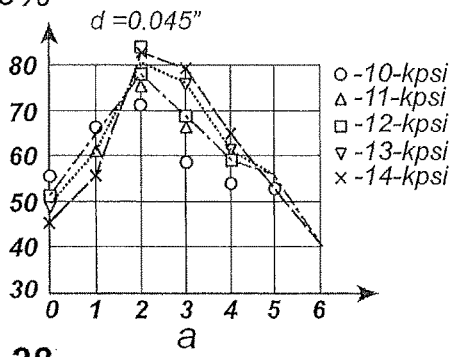
FIG. 28 is a graph plotting ultrasonic power consumed (percent of the rated power of ultrasonic generator for various pressures ranging from 10 k psi to 14 kpsi) versus tip-to-orifice distance 'a' for d=0.045" and A=50%.
Figure 29:
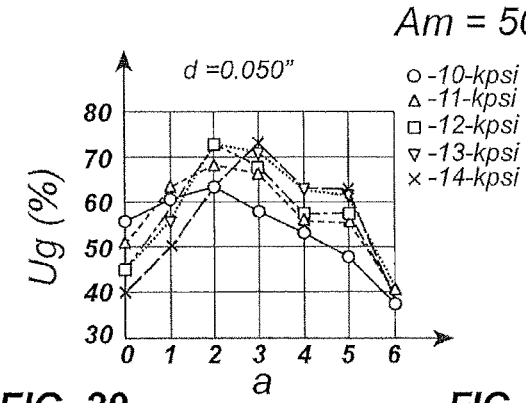
FIG. 29 is a graph plotting ultrasonic power consumed (percent of the rated power of ultrasonic generator for various pressures ranging from 10 k psi to 14 kpsi) versus tip-to-orifice distance 'a' for d=0.050" and A=50%.
Figure 30:
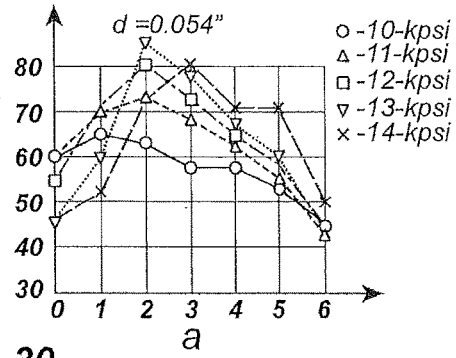
FIG. 30 is a graph plotting ultrasonic power consumed (percent of the rated power of ultrasonic generator for various pressures ranging from 10 k psi to 14 kpsi) versus tip-to-orifice distance 'a' for d=0.054" and A=50%.
Figure 31:
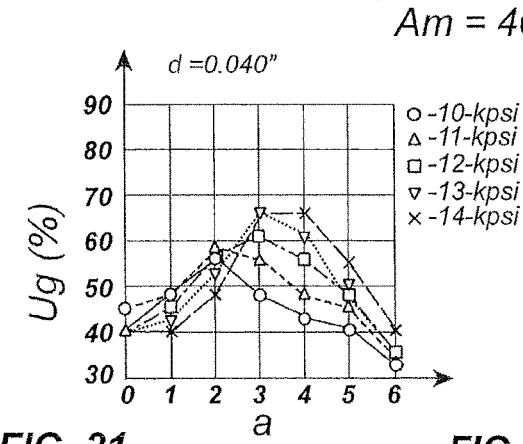
FIG. 31 is a graph plotting ultrasonic power consumed (percent of the rated power of ultrasonic generator for various pressures ranging from 10 k psi to 14 kpsi) versus tip-to-orifice distance 'a' for d=0.040" and A=40%.
Figure 32:
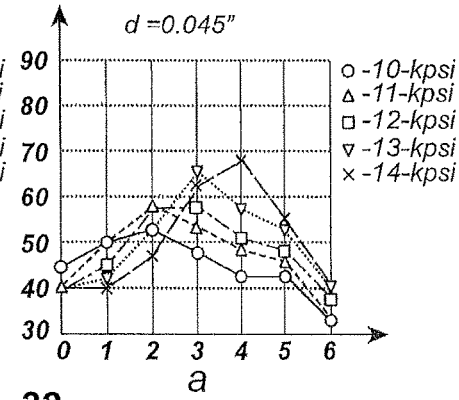
FIG. 32 is a graph plotting ultrasonic power consumed (percent of the rated power of ultrasonic generator for various pressures ranging from 10 kpsi to 14 kpsi) versus tip-to-orifice distance 'a' for d=0.045" and A=40%.
Figure 33:
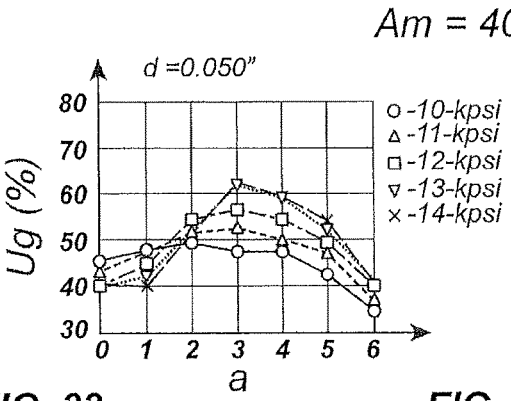
FIG. 33 is a graph plotting ultrasonic power consumed (percent of the rated power of ultrasonic generator for various pressures ranging from 10 kpsi to 14 kpsi) versus tip-to-orifice distance 'a' for d=0.050" and A=40%.
Figure 34:
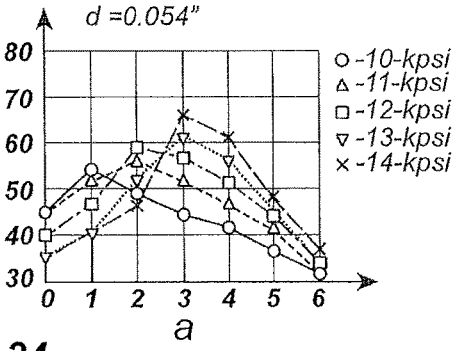
FIG. 34 is a graph plotting ultrasonic power consumed (percent of the rated power of ultrasonic generator for various pressures ranging from 10 kpsi to 14 kpsi) versus tip-to-orifice distance 'a' for d=0.054" and A=40%.
Figure 35:
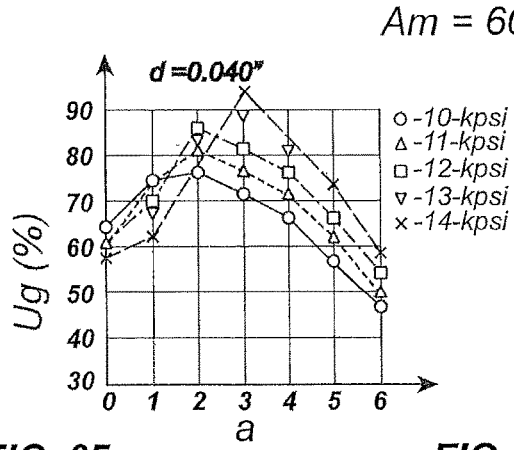
FIG. 35 is a graph plotting ultrasonic power consumed (percent of the rated power of ultrasonic generator for various pressures ranging from 10 kpsi to 14 kpsi) versus tip-to-orifice distance 'a' for d=0.040" and A=60%.
Figure 36:
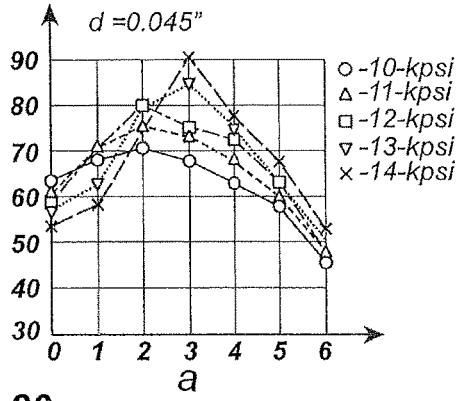
FIG. 36 is a graph plotting ultrasonic power consumed (percent of the rated power of ultrasonic generator for various pressures ranging from 10 kpsi to 14 kpsi) versus tip-to-orifice distance 'a' for d=0.045" and A=60%.
Figure 37:
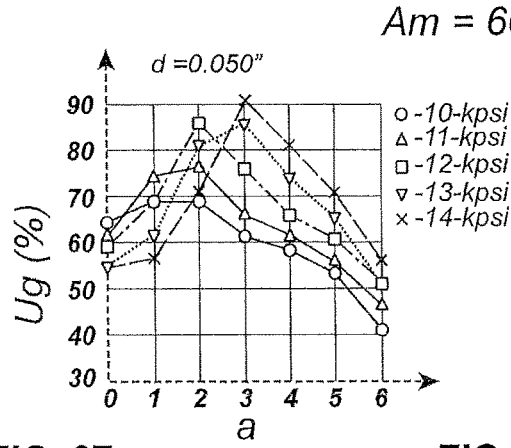
FIG. 37 is a graph plotting ultrasonic power consumed (percent of the rated power of ultrasonic generator for various pressures ranging from 10 kpsi to 14 kpsi) versus tip-to-orifice distance 'a' for d=0.050" and A=60%.
Figure 38:
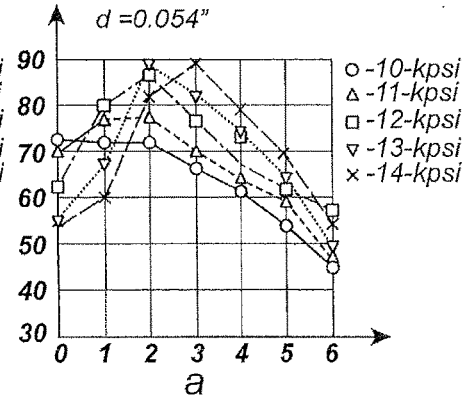
FIG. 38 is a graph plotting ultrasonic power consumed (percent of the rated power of ultrasonic generator for various pressures ranging from 10 kpsi to 14 kpsi) versus tip-to-orifice distance 'a' for d=0.054" and A=60%.

FIG. 26A is a plot of mass loss as a function of standoff distance at a constant pressure and two different values of 'a' as indicated. The plot provides a quantitative confirmation of the qualitative observations made with regard to the representations shown in FIGS. 9-24.

The purpose of the erosion plot (FIG. 26A) is to highlight the influence of the nozzle configurational parameter 'a' on performance for a given set of operating parameters (d=orifice diameter, P=pressure and $V_{tr}$=traverse speed), which are listed on the plot. Mass loss data (erosion of a copper sample), used as a measure of performance, are plotted against standoff distance ($S_d$). When 'a'=1-turn (see nomenclature for the definition of 'turn'), the peak mass loss ($\epsilon m_{peak}$) is 350-mg and occurs at $S_d$=4.1 in (104 mm). When 'a' is set to 2 turns, the peak mass loss decreases to 250-mg, and occurs at $S_d$=4.4 in (112 mm), indicating significant influence of 'a' on performance. Depending on the application, the shift in $S_d$ may or may not be important. Some of the observations from this plot, considered to be useful for setting up the appropriate set of parameters for effective removal of coatings are listed below:

Ideally, it would be desirable to set the standoff distance corresponding to peak mass loss, $\epsilon m_{peak}$. However, constraints of the operating system (for example, access by the robotic arm) or, geometrical complexity of the component may not permit this setup. This is where the concept of "effective zone" {arbitrarily defined as the range of $S_d$ in which the mass loss (performance) decreases by 20-percent of the peak} is useful. In other words, desired surface finish of the component can be achieved by increasing (or, decreasing) the standoff distance, while accepting some loss (20%) in the rate of removal of the coating.

The peak mass loss ($\epsilon m_{peak}$) represents the maximal erosion of the material. Extending this observation to the scenario of removal of coatings, it is easy to see that one can obtain the desired surface finish and the rate of removal by: (a) reducing the magnitude of pressure (flow), (b) increasing the traverse speed or, (c) changing the value of 'a', without changing the operating parameters.

As noted above, changing the magnitude of 'a' shifts the value of $S_d$ at which peak mass loss occurs. For a given hydraulic power (pressure/flow), the distance from the nozzle at which the 'effective zone' starts can be shifted by simply changing the value of 'a'. This observation is useful for the removal of coatings, particularly in removing a hard coating on a soft substrate. Obviously, the effective zone can be shifted by increasing the hydraulic power (pressure, flow or, both).

Thus, by conducting a simple "drop test," the operator can determine an appropriate value of 'a' and operating parameters for the removal of coatings without damage to the substrate.

FIGS. 27-39 are graphs that show how power-delivery efficiency at the tip (Ug) varies as a function of the tip-to-orifice distance 'a' (x-axis) for different pressures and amplitude settings (A) on the ultrasonic generator. The power-delivery efficiency Ug (on the y-axis) represents the percentage of the total energy consumed by the apparatus that is actually delivered at the tip.

In these graphs, the pressures tested are 10 kpsi, 11 kpsi, 12 kpsi, 13 kpsi, and 14 kpsi, i.e. 69 MPa, 76 MPa, 83 MPa, 90 MPa, and 97 MPa, respectively. For FIGS. 27-30, the amplitude A=50%. For FIGS. 31-34, A=40%. For FIGS. 35-38, A=60%. The diameters tested are d={0.045", 0.050", 0.054", 0.065"} or, in metric units, d={1.143 mm, 1.270 mm, 1.372 mm, and 1.651 mm}.

From the standpoint of reliability of the transducer and of the generator, high powers are not conducive. These high powers are believed to produce a wake immediately downstream of the exit plane of the microtip (indicated by D in FIG. 2) that deleteriously affects the performance of the forced pulsed waterjet.

FIGS. 39 to 49D illustrate a number of other nozzle designs and nozzle head configurations that can be used to implement this novel method of surface prepping, coating removal and creating patterns on rocks and other materials.

Figure 39:
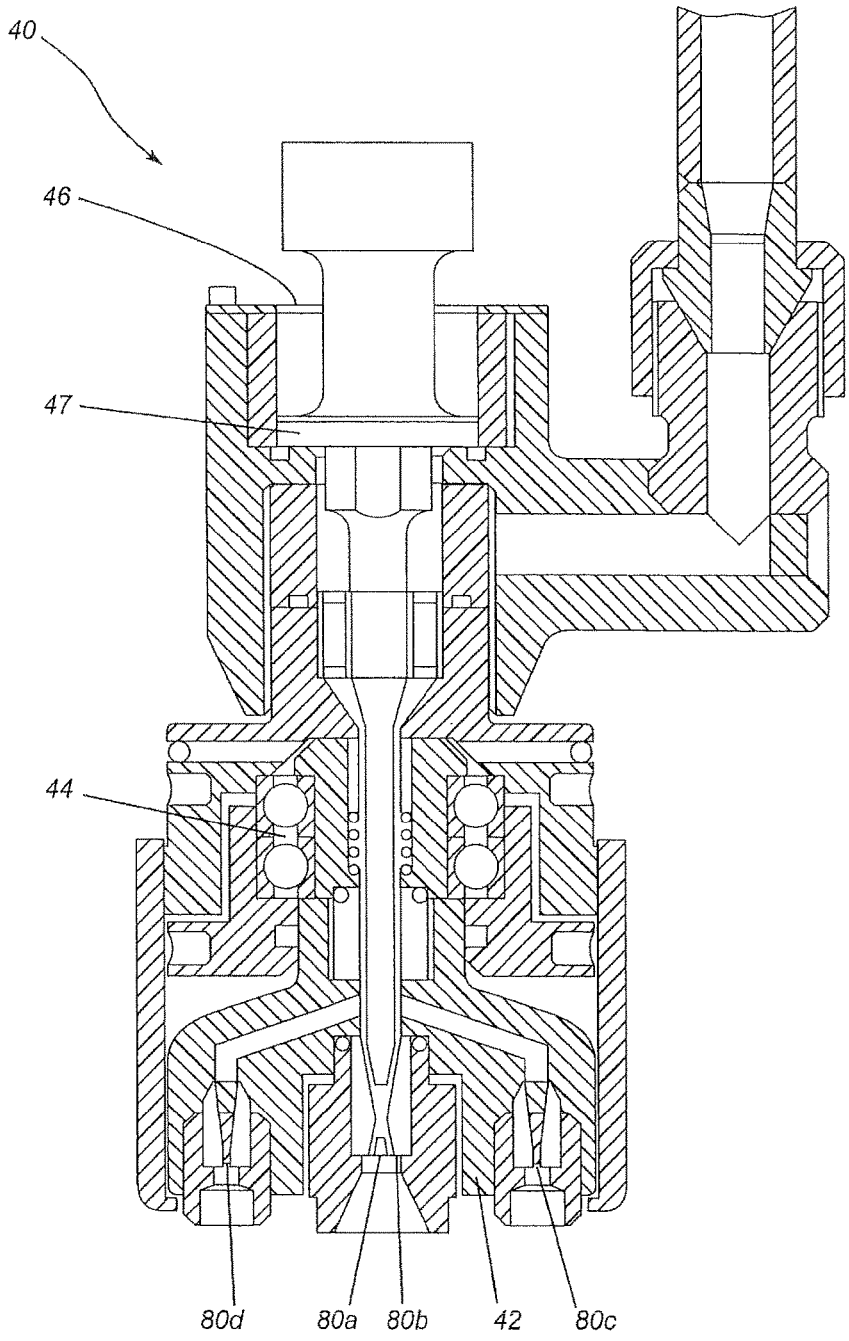
FIG. 39 is a cross-sectional view of a short rotating nozzle assembly.
Figure 39A:
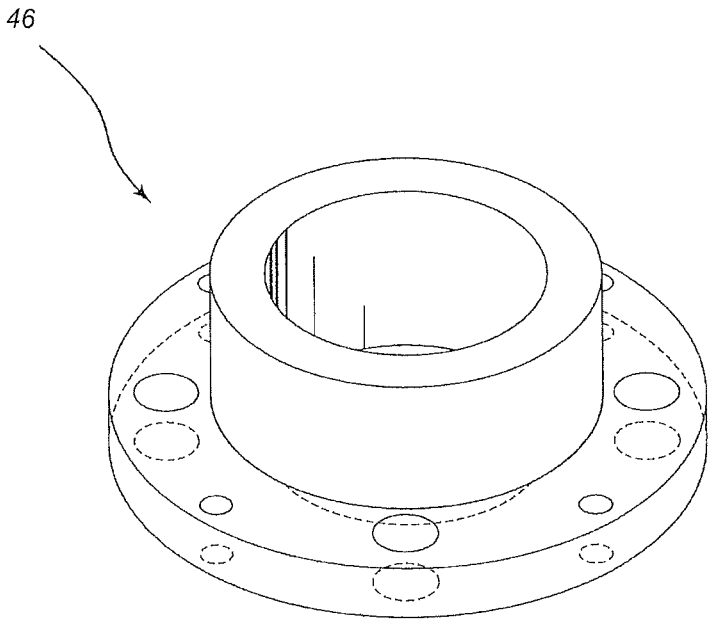
FIG. 39A is an isometric view of a high-pressure chamber nut which is mounted behind the probe flange.

FIG. 39 shows a novel four-orifice self-rotating nozzle 40. This nozzle has a rotating head assembly 42 that rotates with respect to the main body of the nozzle. Bearings 44 are provided to enable this rotation. The nozzle comprises four orifices 80*a*, 80*b*, 80*c*, 80*d*. Inner orifices 80*a*, 80*b* rotate as well as outer orifices 80*c*, 80*d*. The outer jets not only provide torque for self-rotation but also produce forced pulsed waterjets that do useful work in terms of surface prepping or coating removal. This design has been rated to operate up to 20 kpsi (138 MPa). A high-pressure chamber nut 46 (also shown in FIG. 39A) is mounted behind the probe flange 47.

Figure 40A:
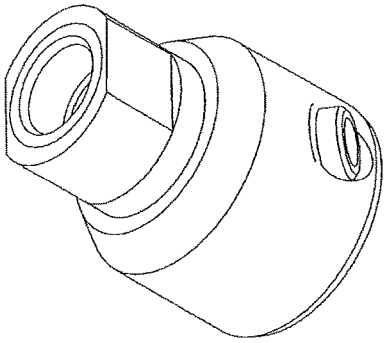
FIG. 40A is an isometric view of a two-orifice nozzle head.
Figure 40B:
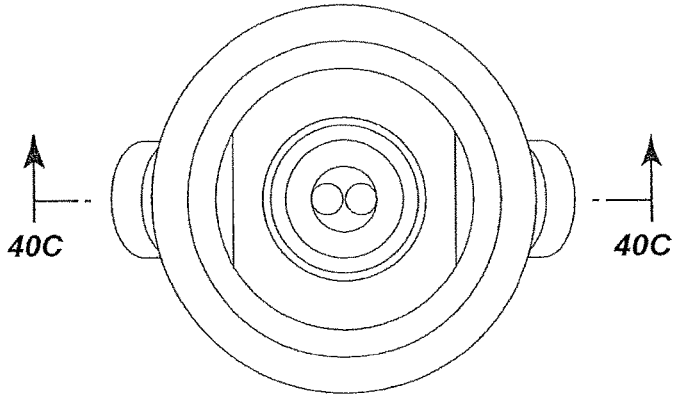
FIG. 40B is a top view of the nozzle head of FIG. 40A.
Figure 40C:
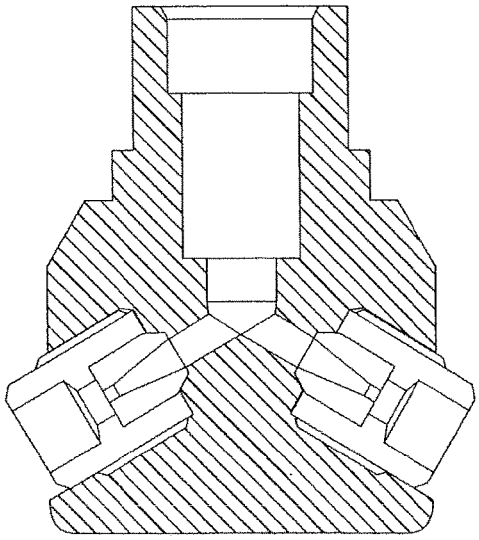
FIG. 40C is a cross-sectional view of the nozzle head of FIG. 40A taken through section A-A.

FIGS. 40A-C show a nozzle head having two angled orifices in accordance with one design. This nozzle head can be mounted to one of the swivels shown in WO/2005/042177 (Vijay).

Figure 41A:
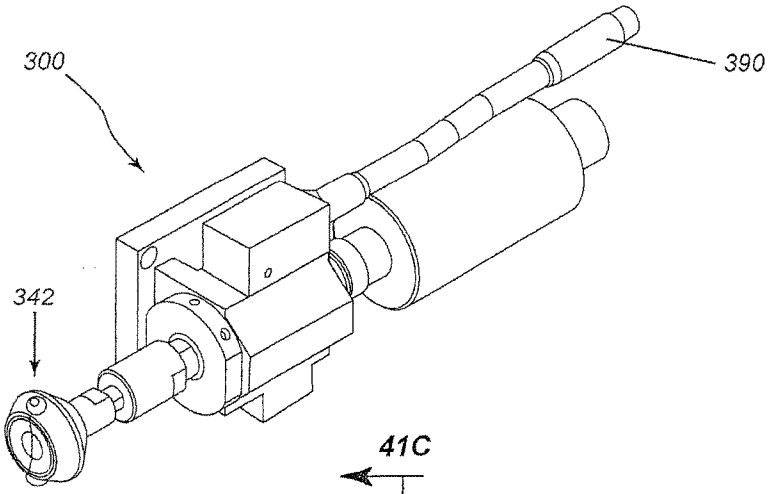
FIG. 41A is an isometric view of an externally driven rotating nozzle.
Figure 41B:
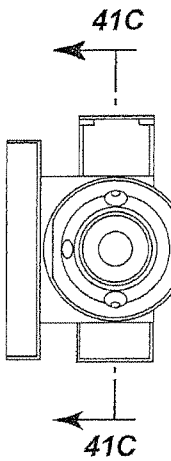
FIG. 41B is a front view of the nozzle of FIG. 41A.
Figure 41C:
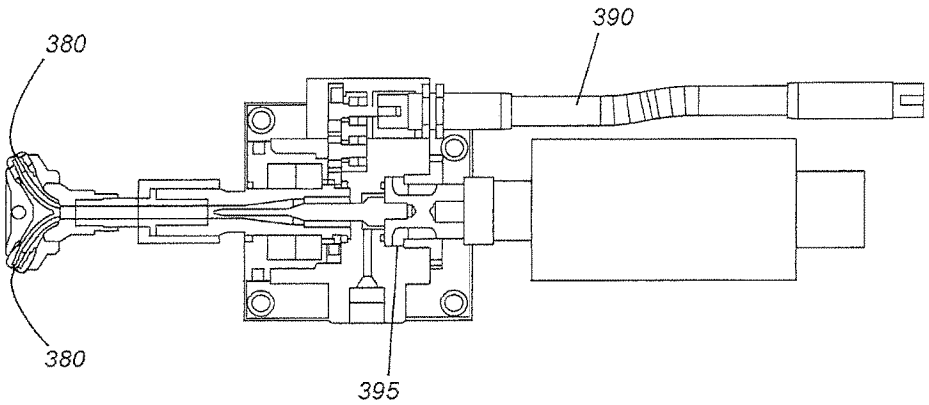
FIG. 41C is a cross-sectional view of the nozzle of FIG. 41A taken through section A-A.
Figure 41D:
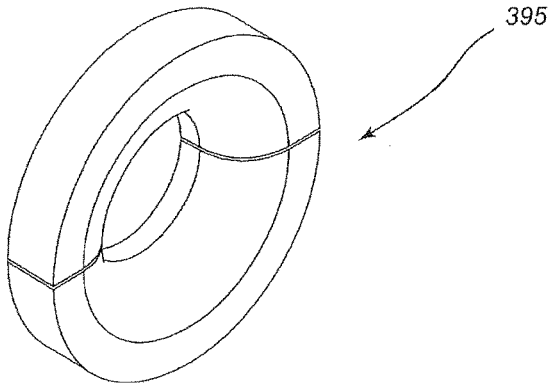
FIG. 41D is an isometric view of a split ring for use in the nozzle of FIG. 41A.
Figure 41E:
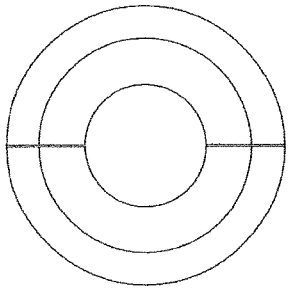
FIG. 41E is a front view of the split ring.
Figure 41F:
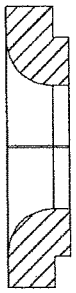
FIG. 41F is a cross-sectional view of the split ring taken through section A-A.
Figure 41G:
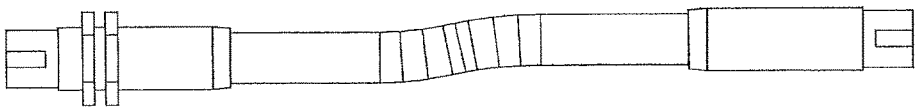
FIG. 41G is a side view of a flexible drive shaft for the nozzle of FIG. 41A.

FIGS. 41A-C show an externally driven rotating nozzle 300 having a nozzle head 342 comprising a pair of orifices 380. A flexible drive shaft 390 is used to externally drive or rotate the rotating nozzle. The nozzle comprises a split ring 395 shown in FIGS. 41D-F. The split ring is composed of two half rings that fit in between the probe flange and the high pressure chamber nut. The nut is tightened to ensure that the probe does not loosen under pressure. Since the split ring has a smaller internal diameter than the outer diameter of the probe stub, it has to be "splitted". Its other important function is to provide support for the probe flange.

Figure 42A:
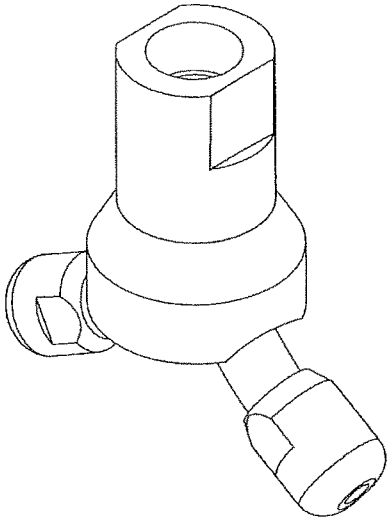
FIG. 42A is an isometric view of another nozzle head.
Figure 42B:
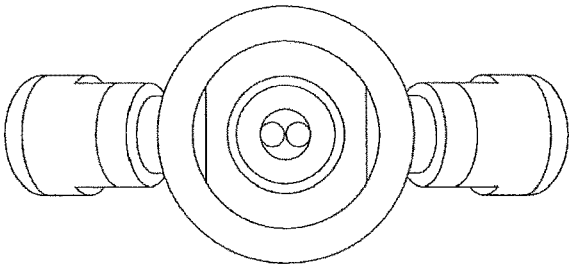
FIG. 42B is a top view of the nozzle head of FIG. 42A.
Figure 42C:
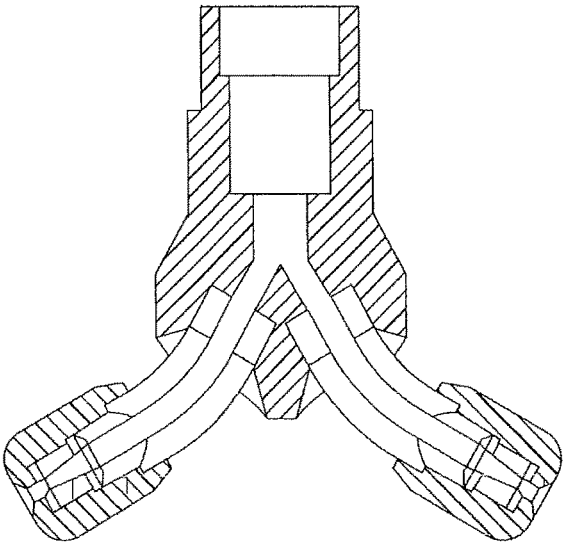
FIG. 42C is a cross-sectional-view of the nozzle head of FIG. 42A.

FIGS. 42A-C show another nozzle head with two curved external conduits leading to respective exit orifices.

Figure 43A:
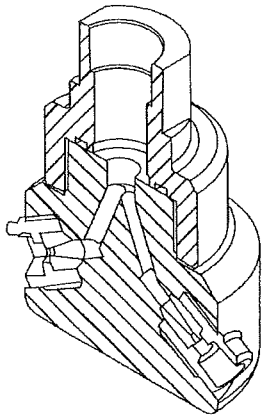
FIG. 43A is an isometric view of a sectioned nozzle head in accordance with another embodiment.
Figure 43B:
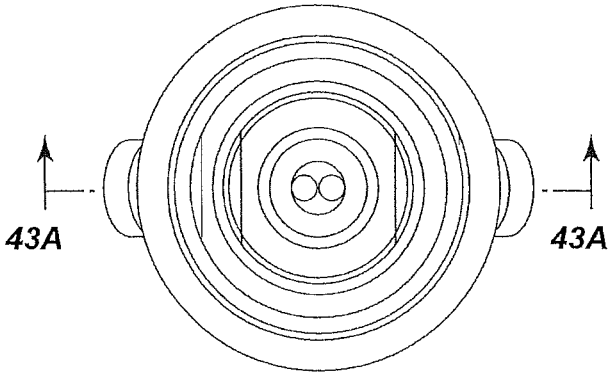
FIG. 43B is a top view of the nozzle head of FIG. 43A.
Figure 43C:
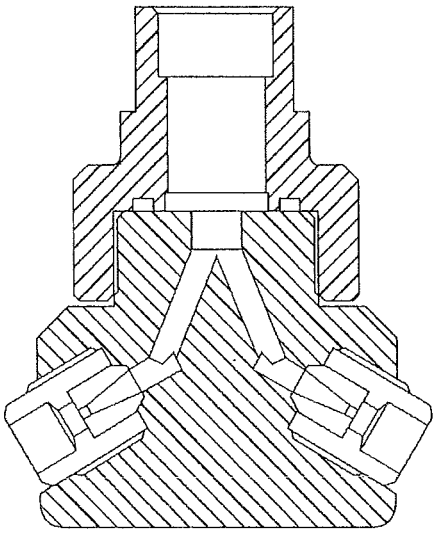
FIG. 43C is a cross-sectional view of the nozzle head of FIG. 43A.

FIGS. 43A-C show yet another nozzle head with two angled internal conduits leading to respective exit orifices.

Figure 44A:
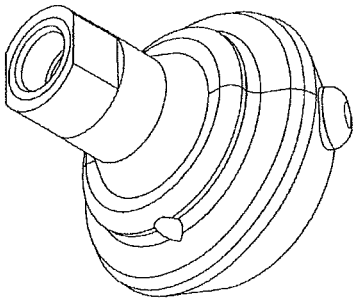
FIG. 44A is an isometric view of a nozzle head in accordance with another embodiment'
Figure 44B:
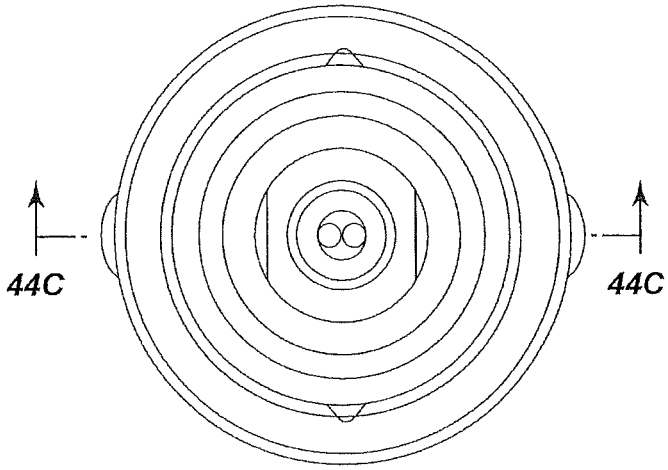
FIG. 44B is a top view of the nozzle head of FIG. 44A.
Figure 44C:
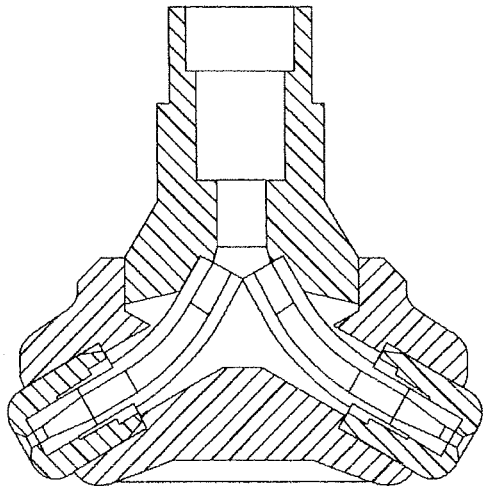
FIG. 44C is a cross-sectional view of the nozzle head of FIG. 44A taken through section A-A.

FIGS. 44A-C show yet another nozzle head with two internal curved conduits leading to respective exit orifices.

Figure 45A:
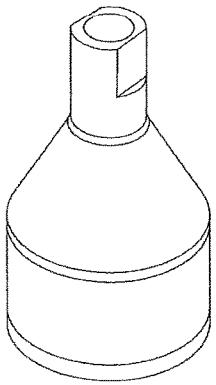
FIG. 45A is an isometric view of a two-orifice rotating nozzle head in accordance with another embodiment.
Figure 45B:
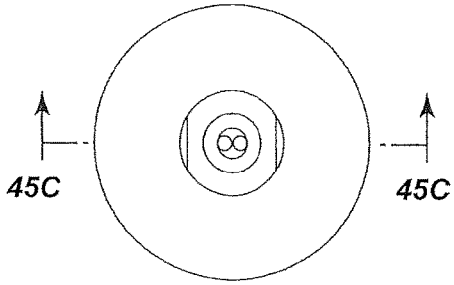
FIG. 45B is a top plan view of the nozzle head of FIG. 45A.
Figure 45D:
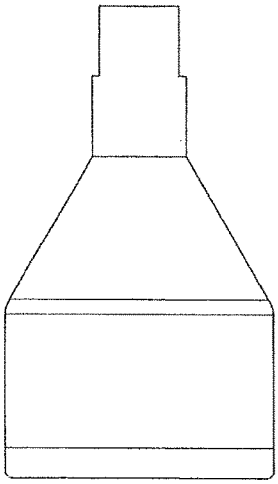
FIG. 45D is a side elevation view of the nozzle head of FIG. 45A.
Figure 45C:
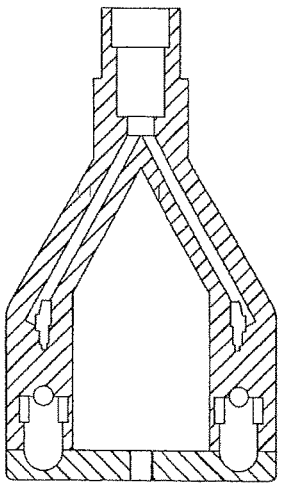
FIG. 45C is a cross-sectional view of the nozzle head of FIG. 45A taken through section A-A.
Figure 46A:
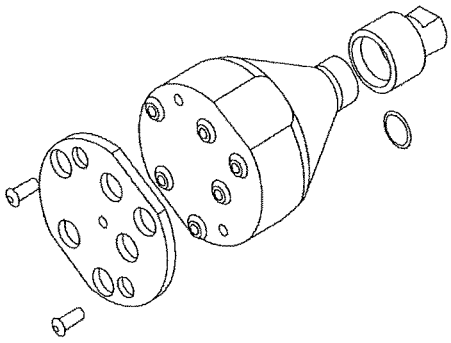
FIG. 46A is an exploded view of a six-orifice rotating nozzle head in accordance with another embodiment.
Figure 46D:
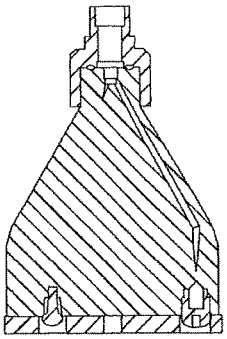
FIG. 46D is a cross-sectional view of the nozzle head of FIG. 46A taken through section A-A.
Figure 46B:
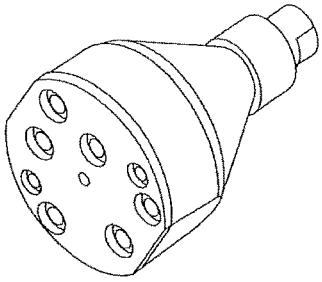
FIG. 46B is an isometric view of the nozzle head of FIG. 46A.
Figure 46C:
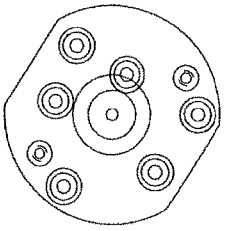
FIG. 46C is a bottom plan view of the nozzle head of FIG. 46A.
Figure 46E:
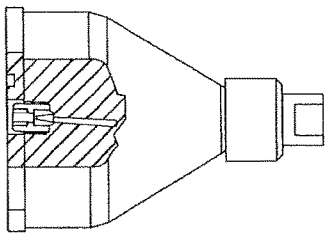
FIG. 46E is a cross-sectional view of the nozzle head of FIG. 46A taken through section B-B.
Figure 46F:
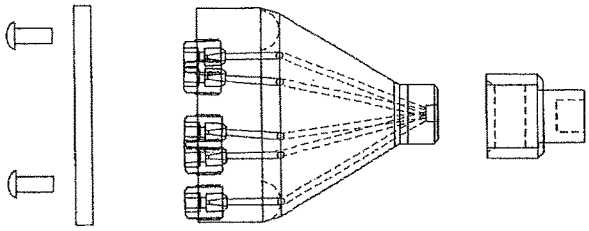
FIG. 46F is a cross-sectional view of the nozzle head of FIG. 46A.
Figure 47A:
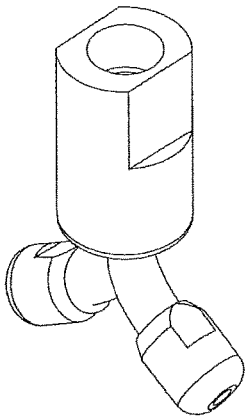
FIG. 47A is an isometric view of a nozzle head in accordance with yet another embodiment.
Figure 47B:
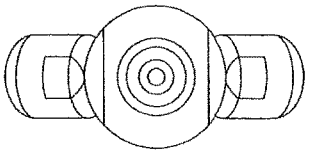
FIG. 47B is a top plan view of the nozzle head of FIG. 47A.
Figure 47C:
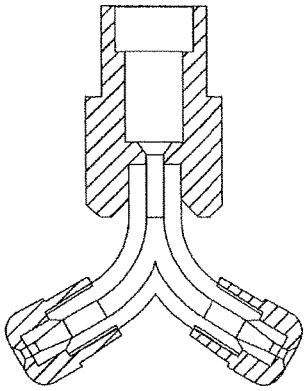
FIG. 47C is a cross-sectional view of the nozzle head of FIG. 47A taken through section A-A.
Figure 47D:
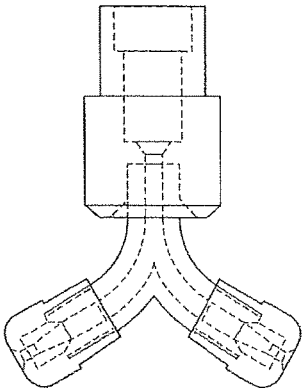
FIG. 47D is a partial cross-sectional view of the nozzle head of FIG. 47A.
Figure 48A:
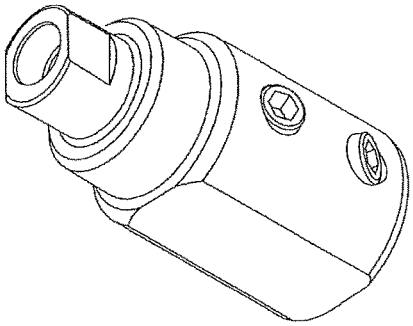
FIG. 48A is an isometric view of a nozzle head in accordance with yet another embodiment.
Figure 48B:
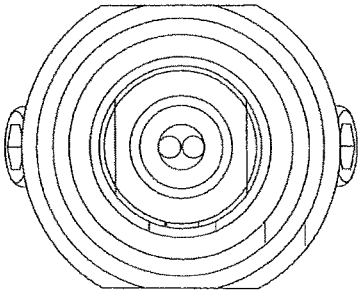
FIG. 48B is a top plan view of the nozzle head of FIG. 48A.
Figure 48C:
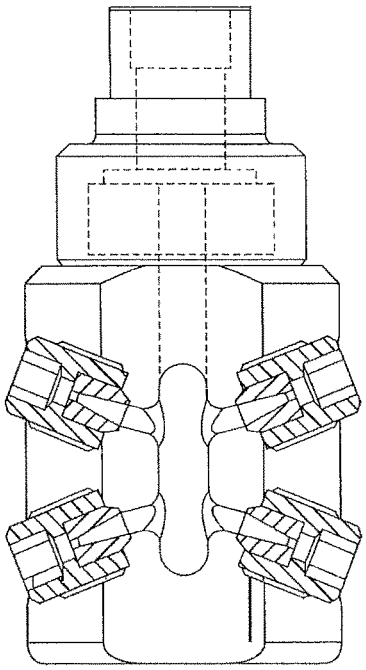
FIG. 48C is a cross-sectional view of the nozzle head of FIG. 48A.
Figure 49A:
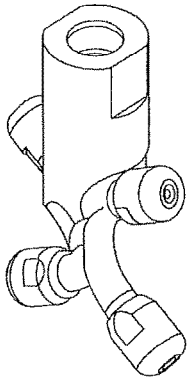
FIG. 49A is an isometric view of a nozzle head in accordance with a further embodiment.
Figure 49B:
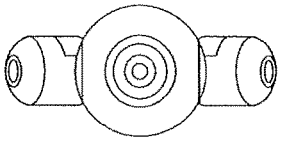
FIG. 49B is a top plan view of the nozzle head of FIG. 49A.
Figure 49C:
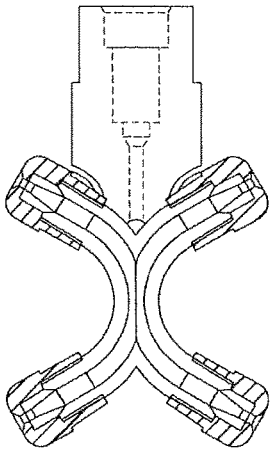
FIG. 49C is a cross-sectional view of the nozzle head of FIG. 49A taken through section A-A.
Figure 49D:
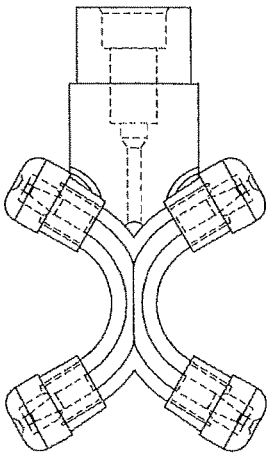
FIG. 49D is another cross-sectional view of the nozzle head of FIG. 49A.

FIGS. 45A-C show a self-rotating nozzle head with two orifices in accordance with another embodiment.

FIGS. 46A-F show a self-rotating nozzle head with six orifices. While most of the other nozzles prep a maximum width of about 2.5 inches per pass, this six-orifice nozzle can performing surface prepping (or pattern creating) with a swath of 5.0 inches per pass.

FIGS. 47A-D show another nozzle head with two external curved conduits leading to respective exit orifices.

FIGS. 48A-D show a four-orifice nozzle head that can be mounted to a robotic system. In a horizontal configuration, this nozzle head has two forwardly angled orifices and two rearwardly angled orifices.

FIGS. 49A-D show another four-orifice nozzle head. In this case, the conduits are fully curved (and is similar to the nozzle shown in FIG. 3F).

Optional Abrasive Entrainment

In a variant of this novel method, an abrasive can be entrained into the waterjet to provide greater erosive capacity. The abrasive can be any conventional materials such as sand. However, in prepping of special components prior to coating, a foreign particle can adversely affect the atomic structure of the substrate materials. In such cases the very particles that are used for coating can be used as abrasive particles. To quote an example, tungsten carbide particles, which are used profusely in thermal spray coating of many components, can be used as abrasive particles to preserve the atomic structure of the substrate materials. In other embodiments, the abrasive can be zeolite or garnet. Alternatively, thermal spray particles can be used for prepping. In this case, the thermal spray particles are partially embedded into the material during prepping. Subsequently, during coating, the same thermal spray particles are coated onto the prepped surface.

This abrasive can be entrained by injecting the abrasive into the pulsed waterjet downstream of the microtip (probe) to avoid eroding the microtip. A mixing chamber can be used downstream of the microtip to ensure that the abrasive is fully and uniformly mixed into the waterjet without disrupting or corrupting the waterjet pulses. In other words, the discrete slugs of water must remain intact after the abrasive mixing/entrainment occurs.

Optional Dual-Mode Operation

Advantageously, the forced pulsed waterjet machine can optionally operate in two modes. That is, if the ultrasonic power is turned off, the machine will work as a conventional waterblaster with a continuous plain waterjet. This can be useful for regular blasting jobs or for the removal of soft coatings. If hard coatings are encountered, activating the ultrasonic generator will enable removal of these coatings. The dual-mode operation thus enables a user to switch between pulsed and continuous waterjets as desired.

Removal of Coatings

In addition to surface prepping and patterning of rock-like materials, this FPWJ technology can be used, as noted above, for removal of coatings, e.g. chrome, HVOF, plasma. Some illustrative operating ranges are tabulated below in terms of Pressure (P), Standoff distance (Sd), and transverse velocity (Vtr). These operating parameters provide excellent surface finish for the various materials without damaging the underlying substrate.

| Material | P (MPa) | Sd (mm) | Vtr(mm/min) | Remarks |
|---|---|---|---|---|
| Chrome-steel | 96.6-100 | 100 | 0 | d = 1.1016<br>exposed for 60 seconds no damage |
| Chrome on 4340 steel | 86.2 | 76.2 | 127.0 | d = 1.626<br>Tc = 0.076-0.127<br>1.93 ≤ Ra ≤ 2.39<br>As = 0.604, Es = 110.8 |
| Chrome on 4340 steel | 96.6 | 101.6 | 254.0 | d = 1.372<br>Tc same as above<br>As = 1.217, Es = 46.6 |
| Chrome on 300M steel | 86.2 | 76.2 | 1016.0 | d = 1.626<br>Tc = 0.076-0.127<br>0.91 ≤ Ra ≤ 1.22<br>As = 4.87, Es = 13.64 |
| Chrome on 300M steel | 96.6 | 101.6 | 127.0 | d = 1.372<br>Tc same as above<br>1.02 ≤ Ra ≤ 1.75<br>As = 0.61, Es = 92.70 |
| HVOF on 4340 steel | 103.5 | 146.0 | 76.2 | d = 1.372<br>Tc = 0.076-0.127<br>2.56 ≤ Ra ≤ 3.45 |

-continued

| Material | P (MPa) | Sd (mm) | Vtr(mm/min) | Remarks |
|---|---|---|---|---|
| HVOF on 4340 steel | 103.5 | 146.0 | 76.2 | increased thickness<br>d = 1.372<br>Tc = 0.203-0.254<br>As = 0.362, Es = 172.6 |
| HVOF on 300M steel | 103.5 | 146.0 | 25.4 | d = 1.372<br>Tc = 0.076-0.127<br>2.11 ≤ Ra ≤ 2.49<br>As = 0.121, Es = 517.7 |
| HVOF on 300M steel (as sprayed) | 103.5 | 146.0 | 12.7 | d = 1.372<br>Tc = 0.216<br>2.84 ≤ Ra ≤ 3.76<br>As = 0.06, Es = 1035.4 |
| HVOF on 300M steel (as sprayed) | 103.5 | 146.0 | 12.7 | 3.56 ≤ Ra ≤ 3.86<br>Same results as above indicating good reproducibility |
| HVOF on 300M steel (as sprayed) | 103.5 | 146.0 | 19.05 | d = 1.372<br>Tc = 0.4445<br>2.24 ≤ Ra ≤ 2.39<br>As = 0.093, Es = 673.4 |

In the foregoing table, the value As represents the removal rate of coating in terms of square feet per hour or square meters per hour. The dimension d represents the orifice diameter in millimeters. The parameter Es represents the energy consumed to remove a unit area (hp-hr/sqft or kW-hr/sqm), i.e. the specific energy. The value P represents the pump pressure P in MPa. The Ra value represents the RMS value of surface roughness in microns. The Sd value represents the standoff distance in millimeters. The Vtr parameter is the transverse velocity of the nozzle in millimeters per minute. Finally, the Tc value represents the coating thickness in millimeters.

The above-tabulated results are presented merely as a number of specific examples to illustrate that the FPWJ coating removal provides excellent results and thus can be used to replace conventional stripping or removal techniques such as grinding, wet chemical baths, grit blasting or ultra-high pressure continuous waterjet. FPWJ requires less energy than CWJ and is far more environmentally friendly than chemical techniques. Not only does FPWJ provide a uniform surface finish, but the mass loss and dimensional changes of the underlying substrate are very minimal, thus enabling this technology to be used in a variety of applications, e.g. in the aerospace sector, for efficient removal of coatings where damage to the underlying component has to be strictly controlled and minimized.

Creating Patterns on Rocks and Rock-Like Materials

Figure 50:
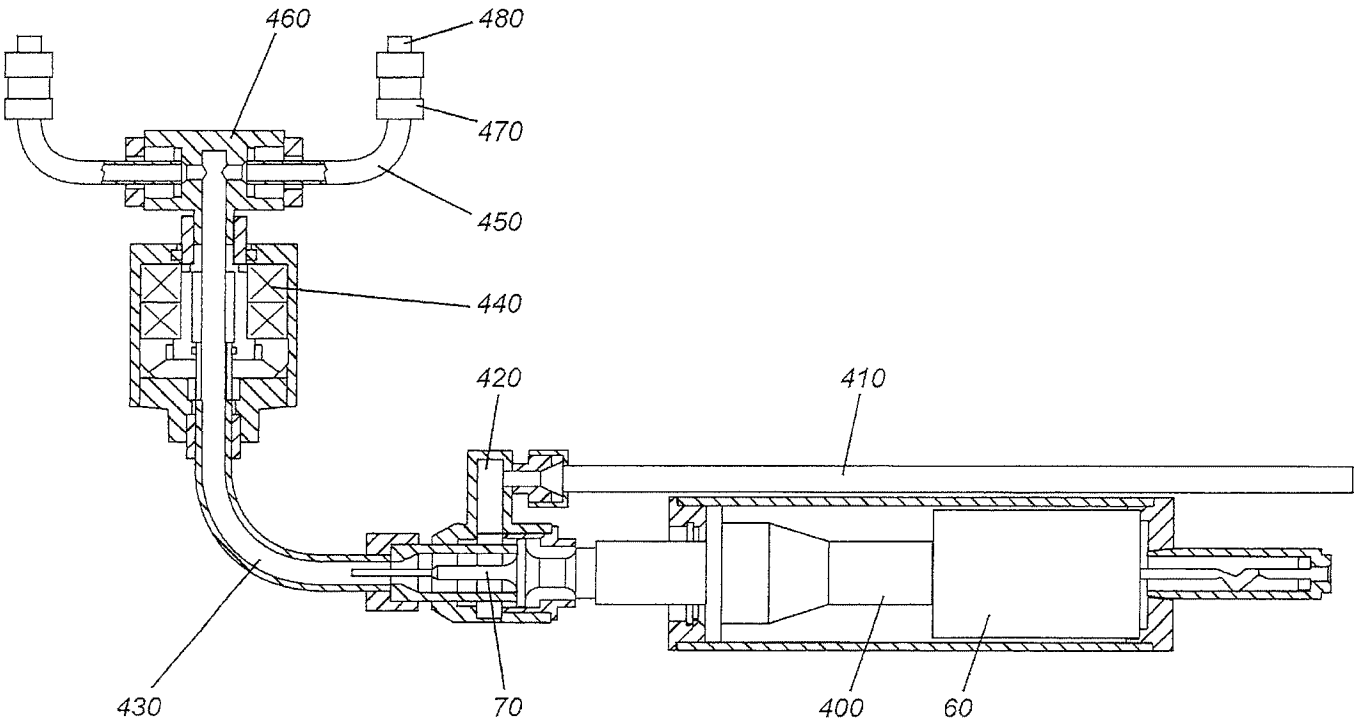
FIG. 50 is a side view of a rock-prepping FPWJ apparatus.

The forced pulsed waterjet nozzle described herein can be adapted for creating patterns on rocks, marble, granite or other rock-like materials (e.g. marble, granite, masonry, etc.) Using this technique, it is possible to inscribe letters, numbers, symbols, words, patterns, shapes, etc. in a rock-like material. An apparatus for creating patterns in rock is presented by way of example in FIG. 50. The apparatus shown in FIG. 50 has a transducer 60 and a booster 400 connected to the transducer downstream of the transducer. High-pressure water tubing 410 delivers pressurized water through a water inlet 420 into a high-pressure mixing chamber 430 where the probe or microtip 70 is oscillated. The waterjet emerges through a curved neck tubing 430 connected to a swivel assembly 440 (having bearings) for rotating the twin nozzles. The flow is bifurcated by a T-connector 460 into a pair of curved tubes 450 that are connected to nozzle holders 470. A nozzle insert 480 and retaining nut are disposed within each of the nozzle holders 470.

Figure 51:
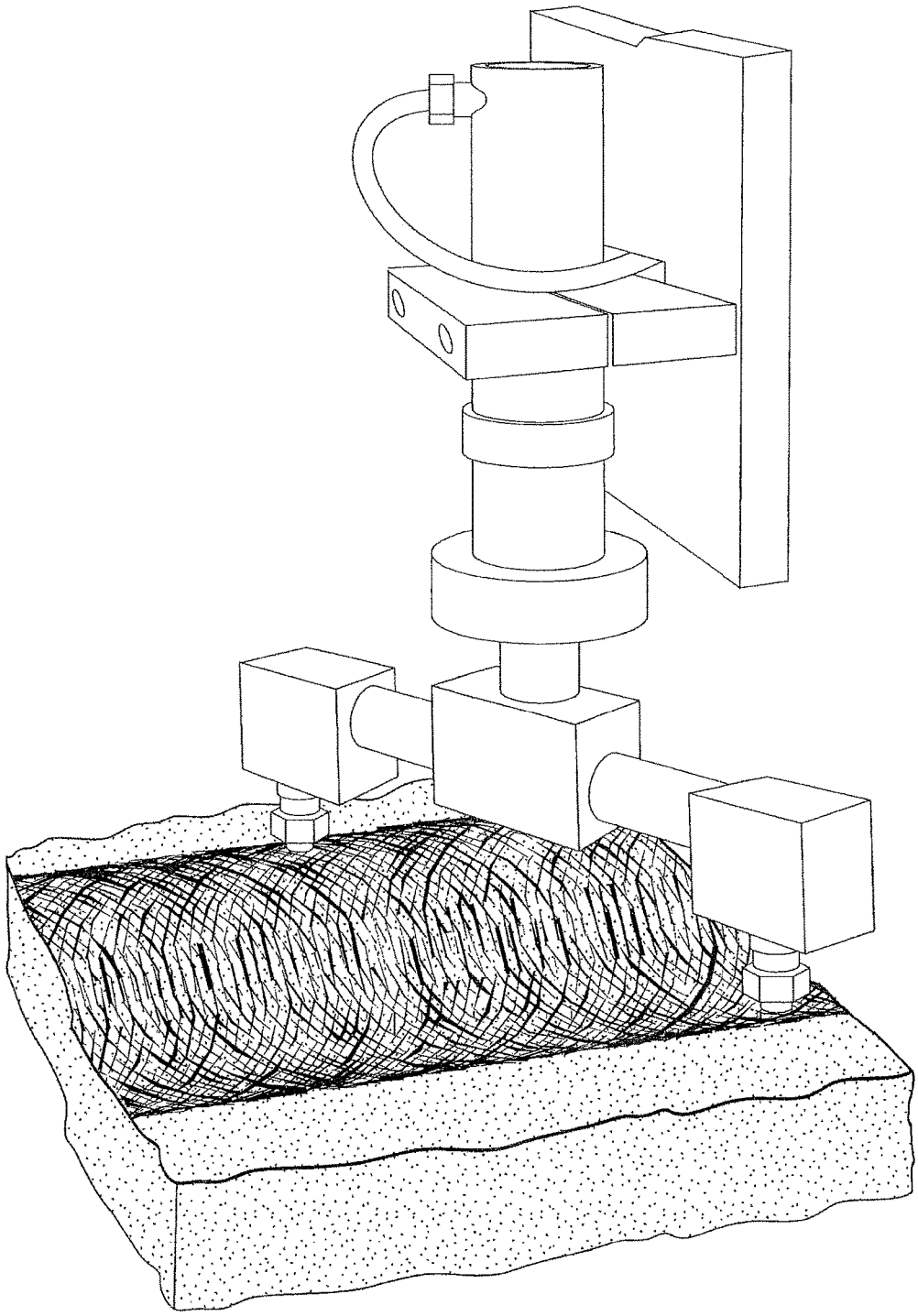
FIG. 51 is a view showing the creation of patterns in a rock or rock-like material.

One example of a rock pattern produced using this FPWJ technology is depicted in FIG. 51. Other attractive or aesthetically pleasing patterns can be produced using FPWJ technology.

The embodiments of the invention described above are intended to be exemplary only. As will be appreciated by those of ordinary skill in the art, to whom this specification is addressed, many obvious variations can be made to the embodiments present herein without departing from the spirit and scope of the invention. The scope of the exclusive right sought by the Applicants is therefore intended to be limited solely by the appended claims.

The invention claimed is:

1. A method of prepping a cylindrical inner surface of a bore using a high-frequency forced pulsed waterjet, the method comprising:

inserting the nozzle inside the bore, wherein the bore has a constant radius;

generating a pressurized waterjet using a high-pressure water pump;

generating a high-frequency signal using a high-frequency signal generator;

applying the high-frequency signal to a transducer to generate the high-frequency forced pulsed waterjet; and rotating a rotatable nozzle head inside the bore to prep the inner cylindrical surface of a substrate material of the bore to a predetermined uniform surface finish characterized by an average surface roughness Ra that is within a predetermined range of surface roughness using the high-frequency forced pulsed waterjet exiting from at least one angled exit orifice of the rotatable nozzle head, wherein the waterjet flows through a curved conduit in the nozzle head to the at least one angled exit orifice that is substantially perpendicular to an axis of rotation of the rotatable nozzle head to direct the waterjet radially outwardly against the surface of the bore.

2. The method as claimed in claim 1 further comprising translating the rotatable nozzle head forwardly and rearwardly inside the bore such that an erosive capacity in a forward pass is greater than an erosive capacity in a rearward pass.

3. The method as claimed in claim 1 wherein rotating the rotatable nozzle head comprises driving the nozzle head using an external flexible drive shaft.

4. The method as claimed in claim 1 wherein rotating the rotatable nozzle head comprises self-rotating the nozzle head using at least one angled orifice.

5. A method of prepping a cylindrical inner surface of a bore using a high-frequency forced pulsed fluidjet, the method comprising:

inserting the nozzle inside the bore, wherein the bore has a constant radius;

generating a pressurized fluidjet using a high-pressure pump;

generating a high-frequency signal using a high-frequency signal generator;

applying the high-frequency signal to a transducer to thereby generate the high-frequency forced pulsed fluidjet; and rotating a rotatable nozzle head inside the bore to prep the surface of a substrate material of the bore to a predetermined uniform surface finish characterized by an average surface roughness Ra that is within a predetermined range of surface roughness using the high-frequency forced pulsed fluidjet exiting from angled exit orifices of the rotatable nozzle head, wherein the fluidjet flows through curved conduits in the nozzle head to each of the angled exit orifices that are substantially perpendicular to an axis of rotation of the rotatable nozzle head to direct each fluidjet radially outwardly against the surface of the bore.

6. The method as claimed in claim 5 further comprising translating the rotatable nozzle head forwardly and rearwardly inside the bore such that an erosive capacity in a forward pass is greater than an erosive capacity in a rearward pass.

7. The method as claimed in claim 5 wherein rotating the rotatable nozzle head comprises driving the nozzle using an external flexible drive shaft.

8. The method as claimed in claim 5 wherein rotating the rotatable nozzle head comprises self-rotating the nozzle head using at least one angled orifice.

* * * * *